US010485389B2

(12) United States Patent
Cahalan et al.

(10) Patent No.: US 10,485,389 B2
(45) Date of Patent: Nov. 26, 2019

(54) CONTAINER INTEGRATION DEVICE AND METHOD OF USE

(71) Applicant: NICE-PAK PRODUCTS, INC., Orangeburg, NY (US)

(72) Inventors: Gerard Anthony Cahalan, New Milford, CT (US); Michael Mooney, Florida, NY (US); Robert P. Julius, Greenwich, CT (US)

(73) Assignee: NICE-PAK PRODUCTS, INC., Orangeburg, NY (US)

( * ) Notice: Subject to any disclaimer, the term of this patent is extended or adjusted under 35 U.S.C. 154(b) by 0 days.

(21) Appl. No.: 15/324,403

(22) PCT Filed: Jul. 10, 2015

(86) PCT No.: PCT/US2015/039922

§ 371 (c)(1),
(2) Date: Jan. 6, 2017

(87) PCT Pub. No.: WO2016/007846

PCT Pub. Date: Jan. 14, 2016

(65) Prior Publication Data

US 2017/0202409 A1 Jul. 20, 2017

Related U.S. Application Data

(60) Provisional application No. 62/023,461, filed on Jul. 11, 2014.

(51) Int. Cl.
*A47K 10/42* (2006.01)
*A47K 10/32* (2006.01)

(52) U.S. Cl.
CPC .... *A47K 10/421* (2013.01); *A47K 2010/3233* (2013.01); *A47K 2010/3266* (2013.01)

(58) Field of Classification Search
CPC ..... A47K 10/421; A47K 2010/3233; A47K 2010/3266

(Continued)

(56) References Cited

U.S. PATENT DOCUMENTS 6,237,765 B1 * 5/2001 Hagen ..... A01K 97/05 206/315.11
7,314,051 B2 * 1/2008 Yuhara ..... A45D 33/006 132/294

(Continued)

OTHER PUBLICATIONS

International Search Report and Written Opinion dated Sep. 30, 2015 in International Application No. PCT/US2015/039922.

(Continued)

*Primary Examiner* — Rakesh Kumar
(74) *Attorney, Agent, or Firm* — Baker Botts L.L.P.

(57) ABSTRACT

An integration device and method of use is provided. The device includes a first member having a lock device; a second member coupled to the first member, wherein the second member receives a container therein having a cover, the first member being movable with respect to the second member between an open configuration and a closed configuration, wherein the cover cooperates with the lock device to lock the first member with the second member in the closed configuration; and a lid coupled to the first member, wherein the lid is engageable with a top tray of the cover to transition the cover between a closed position and an open position.

23 Claims, 33 Drawing Sheets

(58) Field of Classification Search
USPC ..... 221/45
See application file for complete search history.

(56) References Cited

U.S. PATENT DOCUMENTS

| | | | | |
|---|---|---|---|---|
| 7,861,552 | B1 * | 1/2011 | Hughes | A45C 11/20 62/371 |
| 8,939,320 | B2 | 1/2015 | Schiering et al. | |
| 9,272,831 | B2 | 3/2016 | Julius et al. | |
| 9,433,200 | B2 * | 9/2016 | Norman | A01K 97/08 |
| 9,809,356 | B2 * | 11/2017 | Kissner | B65D 43/169 |
| RE46,854 | E * | 5/2018 | Byeon | |
| 2002/0060240 | A1 | 5/2002 | Walsh et al. | |
| 2005/0194393 | A1 * | 9/2005 | Stathoudakis | E04F 21/00 220/836 |
| 2007/0029226 | A1 * | 2/2007 | Yuhara | A45D 33/006 206/581 |
| 2008/0061073 | A1 * | 3/2008 | Laroche | A47K 10/421 221/46 |
| 2009/0223992 | A1 * | 9/2009 | Lorenzati | A47K 10/421 221/34 |
| 2009/0321299 | A1 * | 12/2009 | Gehring | A47K 10/42 206/581 |
| 2012/0118905 | A1 * | 5/2012 | Lindbergh | A47K 10/421 221/1 |
| 2017/0172359 | A1 * | 6/2017 | Roberts | A47K 10/185 |
| 2017/0202409 | A1 * | 7/2017 | Cahalan | A47K 10/421 |

OTHER PUBLICATIONS

Supplementary European Search Report dated Jan. 29, 2018 in EP Application No. 15818361.

* cited by examiner

CONTAINER INTEGRATION DEVICE AND METHOD OF USE

CROSS-REFERENCE TO RELATED APPLICATION

The present application is a U.S. National Stage Patent Application under 35 U.S.C. § 371 of International Application No. PCT/US2015/039922, filed on Jul. 10, 2015, which claims the benefit of U.S. Provisional Application No. 62/023,461 filed on Jul. 11, 2014, the contents of each of which are incorporated herein by reference in their entirety.

FIELD

The disclosed subject matter relates to a device, system and method of a integrating a container with a device system.

BACKGROUND

Disposable moist toilet tissue for personal hygiene is known in the art. Such tissues are generally rectangular in shape and supplied interleaved, as discrete sheets or separably connected. The wipes may be housed in containers, such as in the form of boxes or packets, wherein there is an opening through which the tissues may be removed. Furthermore, the opening may be covered by a lid, such as a hinged cover or adhesive strip that can be opened or closed repeatedly. Typically, these containers are disposable and cannot be refilled with tissue by the consumer. Furthermore, these containers are often not aesthetically pleasing and do not match color schemes of consumer bathrooms.

It is desirable for moist toilet tissue to be housed in refillable containers. In addition to being more aesthetically pleasing than disposable dispensers, such containers can provide a stronger structure for dispensing tissue over long-term usage and be affixed to a surface for permanent placement. A refillable container that can hold and interface with the disposable dispenser provides a convenient way to replace used tissue containers.

Thus, there remains a continued need for an efficient and economic system for a container integration device and system. The presently disclosed subject matter satisfies these and other needs.

SUMMARY

The purpose and advantages of the disclosed subject matter will be set forth in and are apparent from the description that follows, as well as will be learned by practice of the disclosed subject matter. Additional advantages of the disclosed subject matter will be realized and attained by the devices particularly pointed out in the written description and claims hereof, as well as from the appended drawings.

To achieve these and other advantages and in accordance with the purpose of the disclosed subject matter, as embodied and broadly described, the disclosed subject matter includes a system and method for integrating a container with a device system.

According to an embodiment of the disclosed subject matter, an integration device is provided. The device includes a first member having a lock device; a second member coupled to the first member, wherein the second member receives a container therein having a cover, the first member being movable with respect to the second member between an open configuration and a closed configuration, wherein the cover cooperates with the lock device to lock the first member with the second member in the closed configuration; and a lid coupled to the first member, wherein the lid is engageable with a top tray of the cover to transition the cover between a closed position and an open position.

According to another embodiment of the disclosed subject matter, an integration device is provided. The device includes a first member having a lock device; a second member coupled to the first member, wherein the second member receives a container therein having a cover, the first member being movable with respect to the second member between an open configuration and a closed configuration, wherein the cover cooperates with the lock device to lock the first member with the second member in the closed configuration, In accordance with another aspect of the disclosed subject matter, a method of integrating a container with a device system is further provided. The method includes providing an integration device as described herein; inserting a container having a cover into the second member; and moving the first member with respect to the second member to the closed configuration by engaging the cover with the lock device to lock the first member with the second member in the closed configuration.

It is to be understood that both the foregoing general description and the following detailed description and drawings are examples and are provided for purpose of illustration and not intended to limit the scope of the disclosed subject matter in any manner.

The accompanying drawings, which are incorporated in and constitute part of this specification, are included to illustrate and provide a further understanding of the devices of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which.

DETAILED DESCRIPTION

Reference will now be made in detail to various embodiments of the disclosed subject matter, examples of which are illustrated in the accompanying drawings. The examples herein are not intended to limit the scope of the disclosed subject matter in any manner. The disclosed subject matter will be described in conjunction with the detailed description of the system.

The term "about" or "approximately" means within an acceptable error range for the particular value as determined by one of ordinary skill in the art, which will depend in part on how the value is measured or determined, i.e., the limitations of the measurement system.

The presently disclosed subject matter provides a system, device, and method for integrating a container with the device. The device includes a first member having a lock device; a second member coupled to the first member, wherein the second member receives a container therein having a cover, the first member being movable with respect to the second member between an open configuration and a closed configuration, wherein the cover cooperates with the lock device to lock the first member with the second member in the closed configuration; and a lid coupled to the first member, wherein the lid is engageable with a top tray of the cover to transition the cover between a closed position and an open position.

Figure 1:
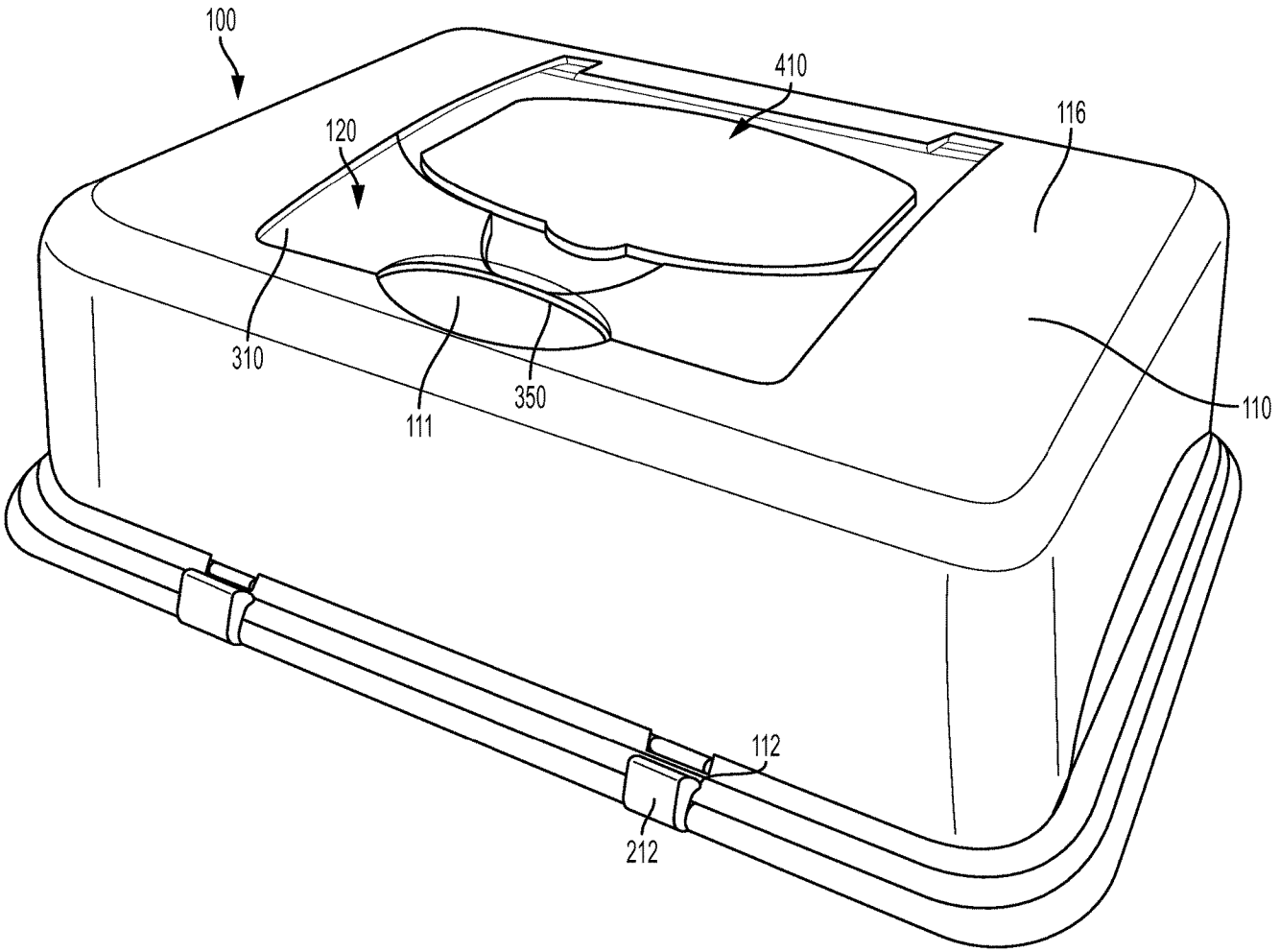
FIG. 1 is a perspective view of the integration device, according to an embodiment of the disclosed subject matter.
Figure 2:
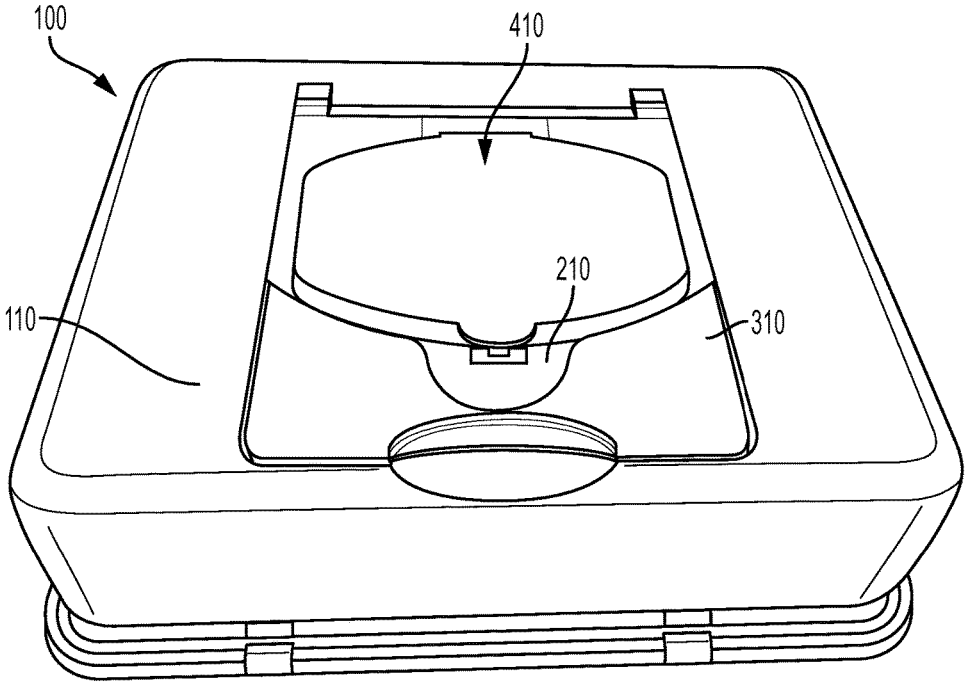
FIG. 2 is a top front view of the integration device of FIG. 1, according to an embodiment of the disclosed subject matter.
Figure 3:
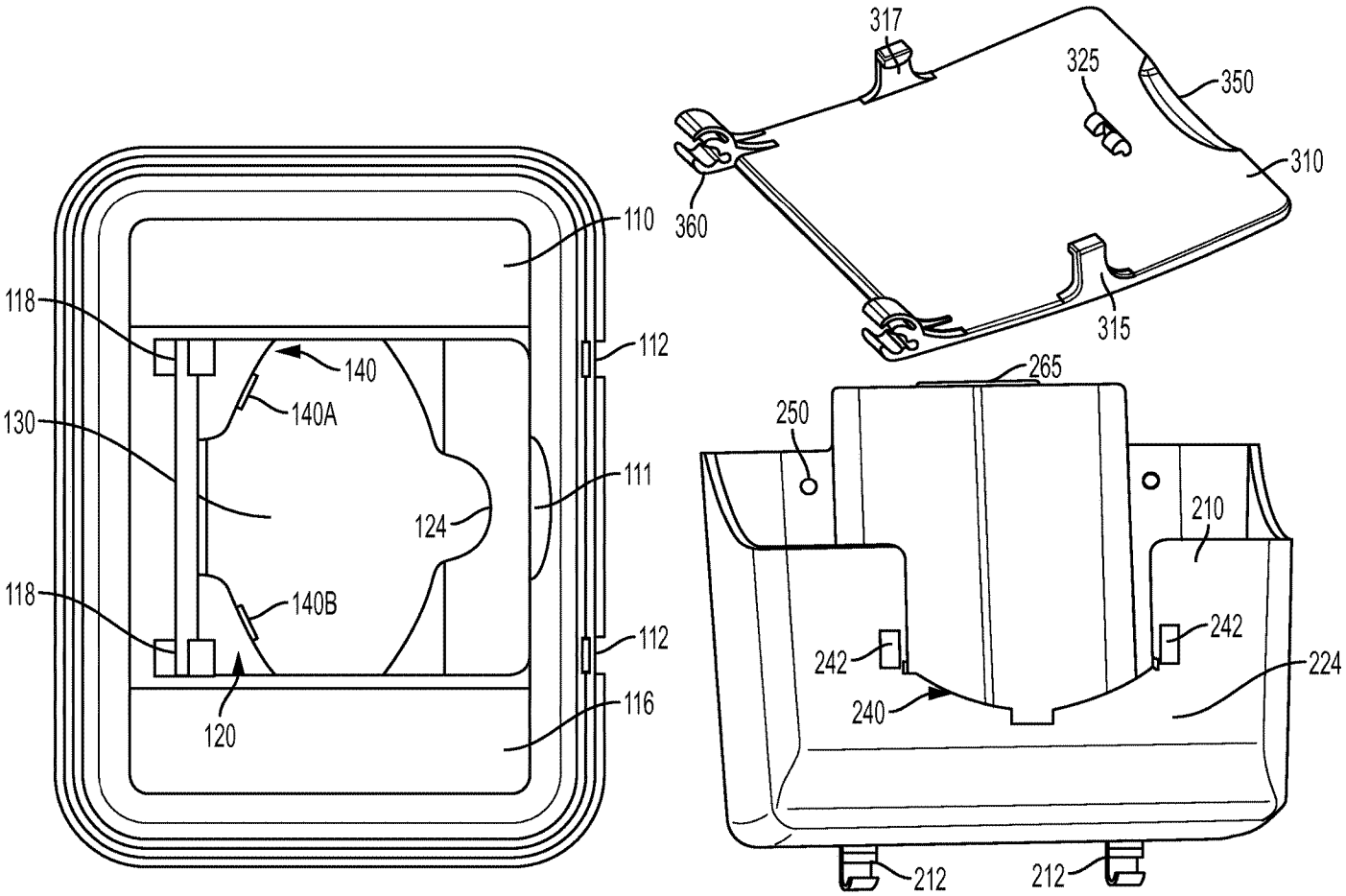
FIG. 3 is an exploded view of an integration device, according to an embodiment of the disclosed subject matter.

Solely for purpose of illustration, FIG. 1 shows a perspective view of the integration device 100 and FIG. 2 is a top front view of the integration device of FIG. 1, according to an embodiment of the disclosed subject matter. The integration device 100 houses an insertable container 410. The device 100 includes a first member 110, a second member (not shown), and a lid 310. FIG. 3 is an exploded view of an integration device 100 depicting the first member 110, second member 210, and lid 310.

Figure 4:
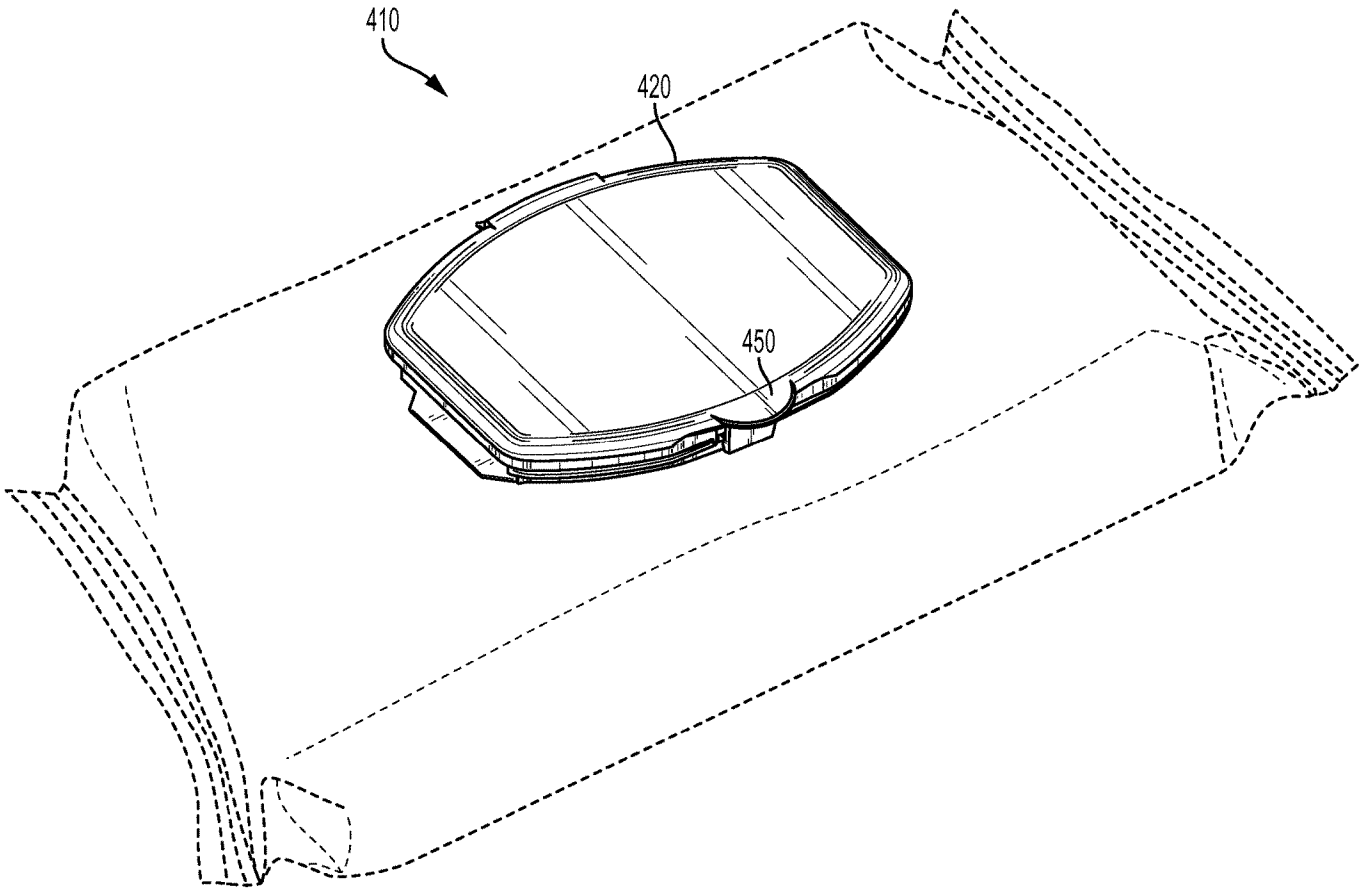
FIG. 4 is a perspective view of a container with a cover couplable with an integration device, according to an embodiment of the disclosed subject matter.
Figure 5:
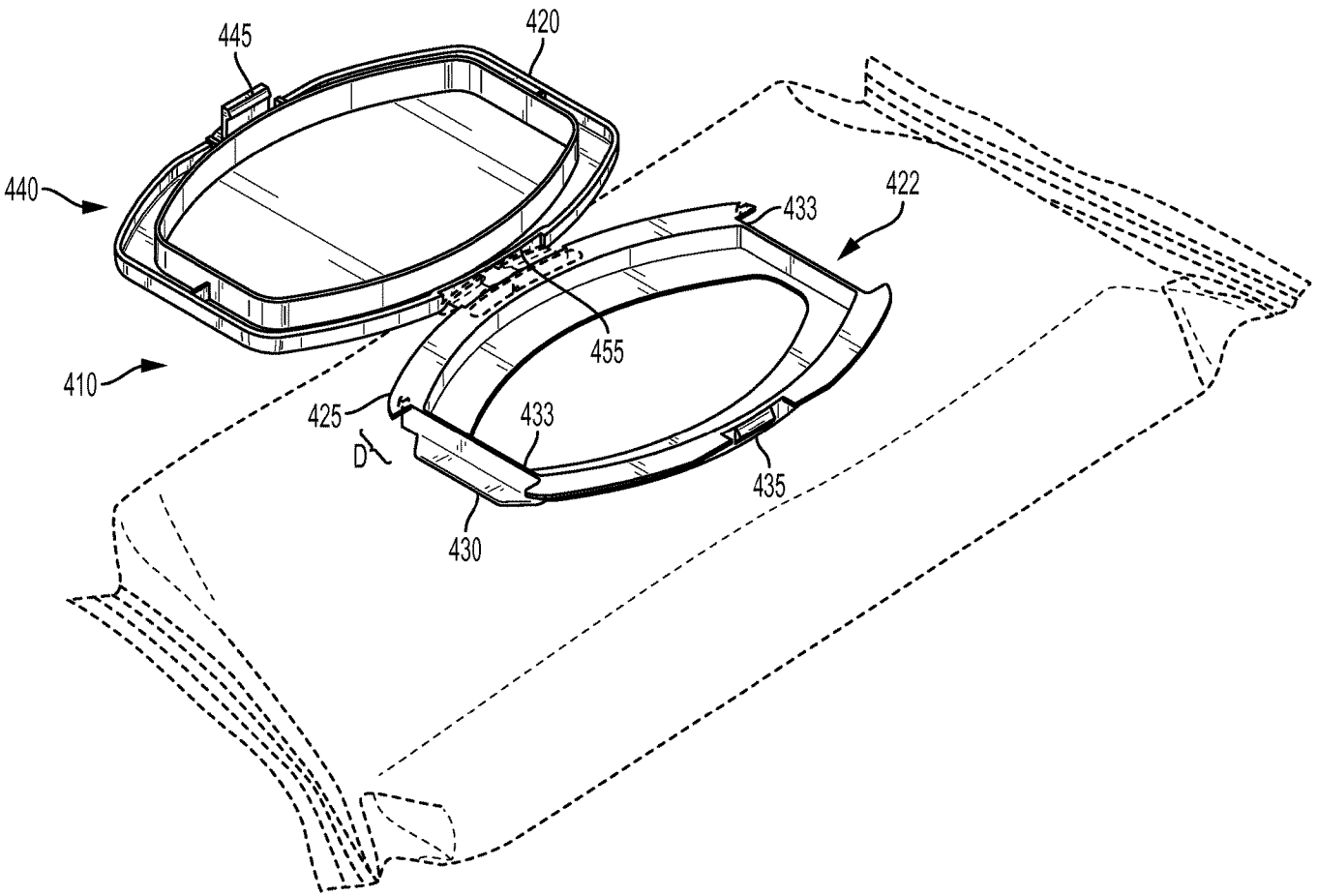
FIG. 5 is a perspective view of the container of FIG. 4 with the cover in the open position, according to an embodiment of the disclosed subject matter.

FIG. 4 and FIG. 5 depict a suitable container 410 receivable in the device (not shown). As shown in FIG. 4, the container 410 includes a cover 420 in a closed position whereas FIG. 5 shows the cover in an open position. The cover can be independently fully extended at any suitable angle, such as for example, up to approximately 180°. The container 410 can contain any article capable of dispensing through the cover 420. For example, the article can include moist toilet tissue, wipes, nonwovens, and the like.

Figure 6:
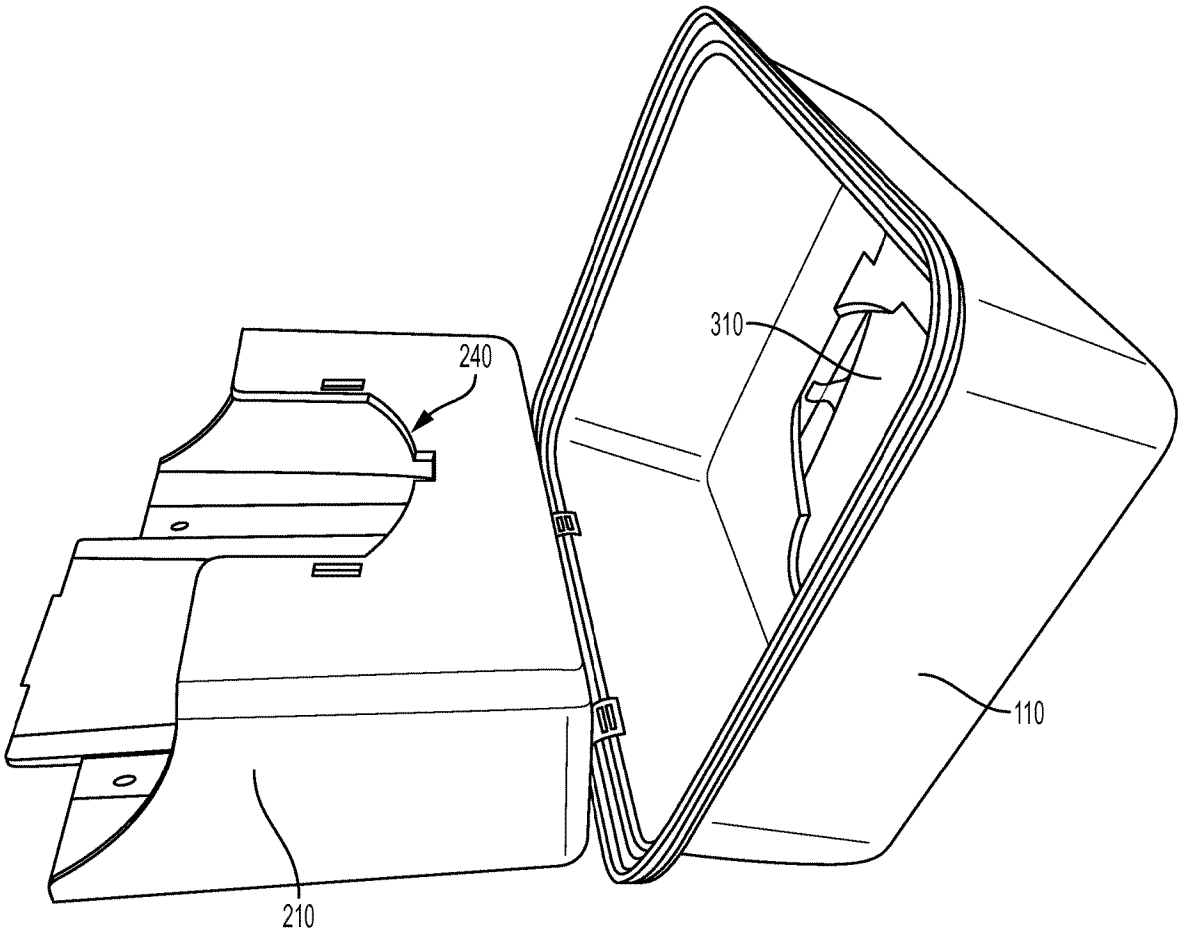
FIG. 6 is a side perspective view of the integration device of FIG. 1, according to an embodiment of the disclosed subject matter.

FIG. 6 is a side perspective view of the integration device of FIG. 1. As shown, the second member 210 is coupled to the first member 110 at a juncture. As such, the first member 110 and the second member 210 are movable with respect to each other between an open configuration and a closed configuration. FIG. 6 depicts the device in an open configuration whereas FIG. 1 depicts the device in the closed configuration. The first and second members 110, 210 can be coupled together in any suitable manner that permits movement with respect to each other, such as but not limited to, joint, hinge, pivot couplings and the like. As best shown in FIG. 3, the first member 110 has two bars 112 and two recesses that cooperate with two hook structures 212 of the second member 210 for pivotable engagement of the first member with the second member.

As best shown in FIGS. 1 and 3, the first member 110 has a top face 116 that comprises at least one recessed portion 120. The recessed portion 120 houses the lid 310 in the closed position of the lid. The recessed portion 120 can additionally include at least one tab portion 124 to enable a finger to be inserted underneath a container cover for moving the cover an open position, if desired. The tab portion 124 also allows for additional clearance of a finger tab of the cover, as further described below. The recessed portion 120 defines an aperture 130 that receives a top tray of the container cover, as further discussed herein. The aperture 130 also enables a consumer a window to dispense articles from the container.

As depicted in FIG. 3, the first member 110 additionally has a lock device 140. The lock device 140 comprises at least one flange. When the device 100 includes the container 410 therein, the at least one flange is disposed below a bottom tray of the container cover 420 to lock the first member 110 with the second member 210 in the closed configuration. As shown in FIG. 3, the lock device 140 includes two flanges 140A, 140B in this embodiment. However, any number of flange(s) are contemplated herein. The lock device 140 is further discussed herein with respect to FIG. 13.

Figure 7:
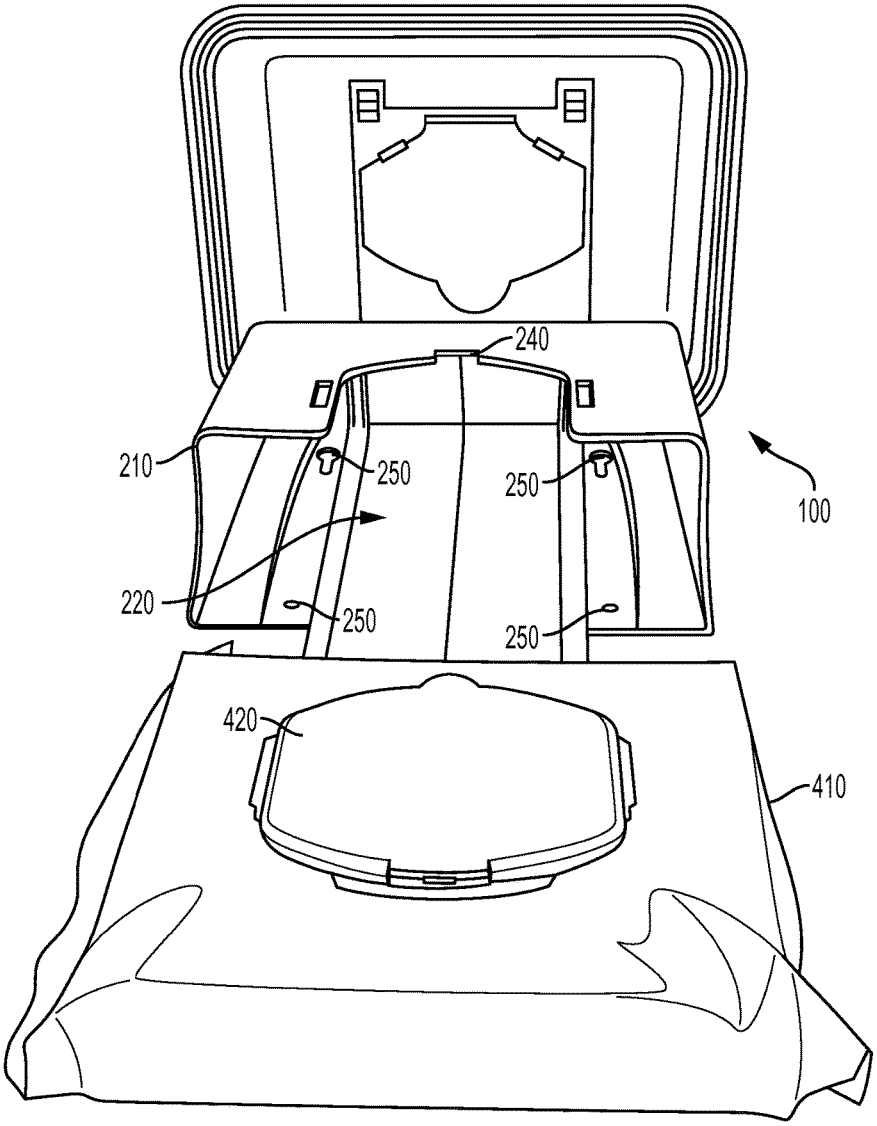
FIG. 7 is a top front interior view of the integration device of FIG. 1, according to an embodiment of the disclosed subject matter.
Figure 8A:
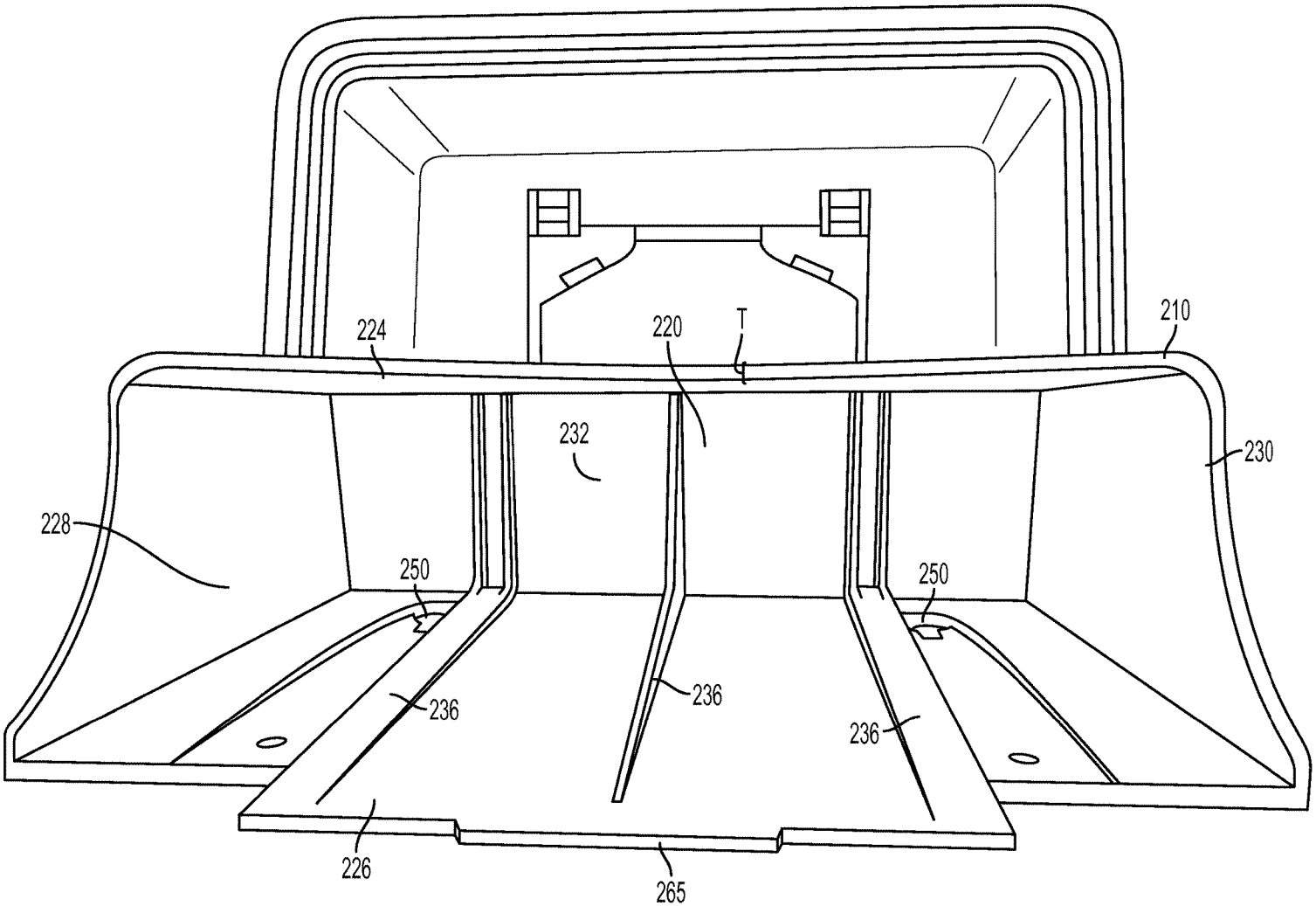
FIG. 8A is a front interior view of the second member of the integration device of FIG. 1, according to an embodiment of the disclosed subject matter.

FIG. 7 shows a top front interior view of the integration device 100 of FIG. 1 and a suitable container 410 compatible with the device. The second member 210 defines an interior 220 that houses the container 410. FIG. 8A is a front interior view of the second member 210 of integration device 100. As depicted, the second member 210 defines a top segment 224, a bottom segment 226, first and second sidewalls 228, 230 and a back segment 232. The second member comprises a thickness dimension T at the top segment 224. The thickness dimension T can be any suitable thickness such as ranging up to approximately one quarter of an inch. An inner surface of the bottom segment 226 and back segment 232 can include sections having different contours and thicknesses. In the embodiment of FIG. 8A, these sections are depicted as ridges 236 that can encourage an inserted container to shift toward the top segment 224 of the second member as the container decreases in size due to the dispensing of articles therefrom.

Figure 8B:
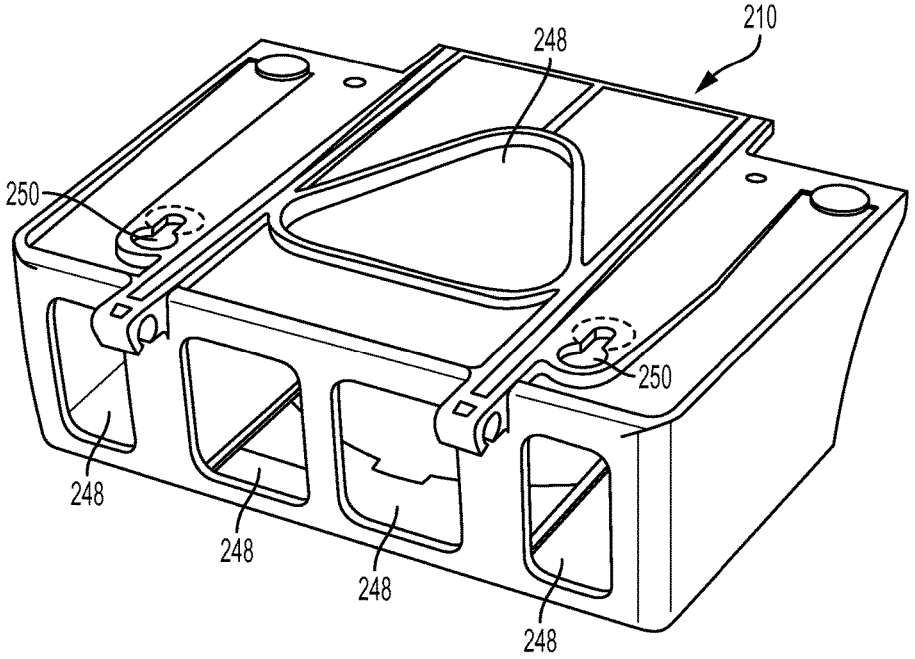
FIG. 8B is a back view of the second member of an integration device, according to another embodiment of the disclosed subject matter.

As depicted in FIG. 8B, the bottom segment 226 and/or the back segment 232 can additionally include one or more apertures 248 to allow a user to insert a finger therein to engage with the container 410. When the device 100 is disposed on a flat surface and articles are removed from the container 410, the distance between the aperture 130 of the first member and a next article becomes greater since the force of gravity is operating against the container and articles therein. The one or more apertures can allow a user to insert a finger into the interior 220 of the second member to push the container 410 towards the aperture 130 to decrease the distance for dispensing an article from the container. The one or more apertures can also reduce the weight of the device and decrease cost of manufacturing.

Although the device can be disposed on a flat surface such as a table as shown in FIG. 1, the device can also be hung vertically from a wall. As such, the bottom segment 226 and back segment 232 can additionally include at least one aperture 250 to receive a securement device to secure the device to a wall. The securement device can include any suitable securement device such as an adhesive system, bracket system or screws/bolts and is further discussed herein with respect to FIGS. 27A-27E.

Figure 9:
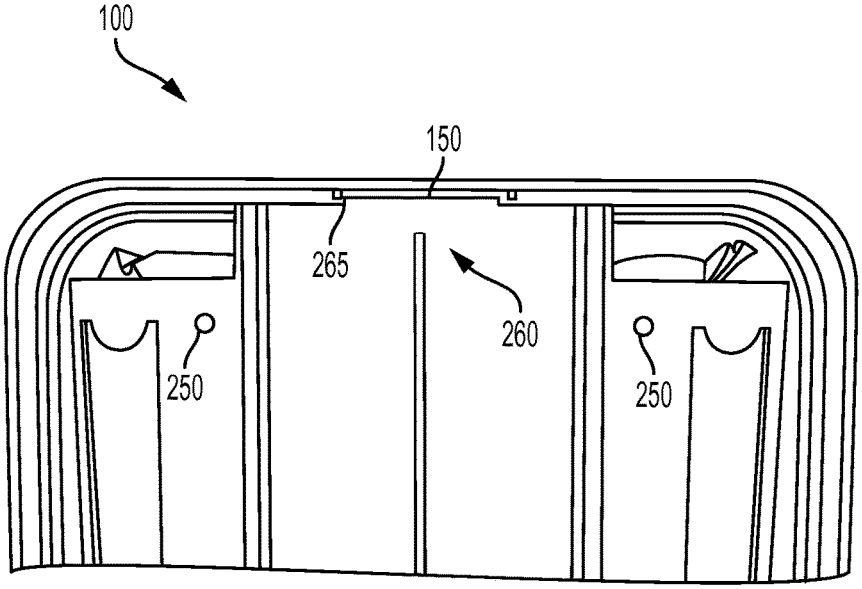
FIG. 9 depicts a back view of the device of FIG. 1, according to an embodiment of the disclosed subject matter.

The device can additionally include a latch mechanism to further facilitate keeping the device in the closed configuration and in particular, when the device is affixed to a wall. FIG. 9 depicts a back view of the device of FIG. 1 depicting a suitable latch mechanism 260. The latch mechanism 260 is defined by the first member 110 and the second member 210 to latch the device 100 in the closed configuration and, in particular, when the interior 220 of the second member 210 is empty. In one embodiment, the first member includes a latch ridge 150 that cooperates with a latch ridge 265 of the second member. As depicted in FIG. 9, a back of the latch ridge 150 abuts a front of the latch ridge 265 to keep the device in the closed configuration. When the device 100 is affixed to a wall, the first member is movable with respect to the second member 210 to allow the device to move from the open configuration to the closed configuration. Accordingly, when in the closed configuration, the weight of the first member 110 causes the latch ridge 150 to latch with and lock upon the latch ridge 265. To transition the device to the open configuration when the device does not include a container, a consumer need only to lift upward the first member 110 to unlatch the latch ridge 150 with the latch ridge 265 to allow the latch 150 to clear a distance past the latch ridge 265. The latch ridges 150, 265 can each respectively have any suitable cross-section that allows for secure engagement with each other. In one example, the latch ridges each have a triangular cross-section with a curved upper lip and mate to together form a rectangular cross-section unit. As known in the art, other latch mechanisms can be used as understood in the industry and contemplated herein.

As best shown in FIGS. 3 and 7, the top segment 224 of the second member 210 defines a border 240 that complements a shape of the cover 420 of the container 410. As such, the cover 420 of the container is enabled to fit snug with the border 240 of the second member 210. The cover and the border can have any suitable shape for cooperation with each other.

Turning back to FIG. 5, the cover 420 can include a bottom tray 422 and a top tray 440 that are coupled together by a hinge 455, such as a butterfly hinge. The top tray 440 can additionally include a clasp 445 that mates with a ridge 435 of the bottom tray 422 to close the cover and in some embodiments, seal the contents of the container 410, such as a hermetic seal or plug seal. The closed position of the top tray with the bottom tray hinders evaporation of moisture, if provided, within the container 410. Articles within the container 410 can be dispensed via a tortuous path as desired to further hinder evaporation. Further details regarding suitable covers and containers can be found in the commonly assigned U.S. Publication No. 2014/0048553, entitled "Dispenser," and in the commonly assigned U.S. Publication No. 2014/0103058, entitled "Wipes Dispenser and Disposal," the contents of each of which is incorporated by reference in their entireties. As best shown in FIG. 4, the top tray 440 can additionally include a finger tab 450 to allow a consumer to grip the top tray and move the top tray to an open position.

Figure 10:
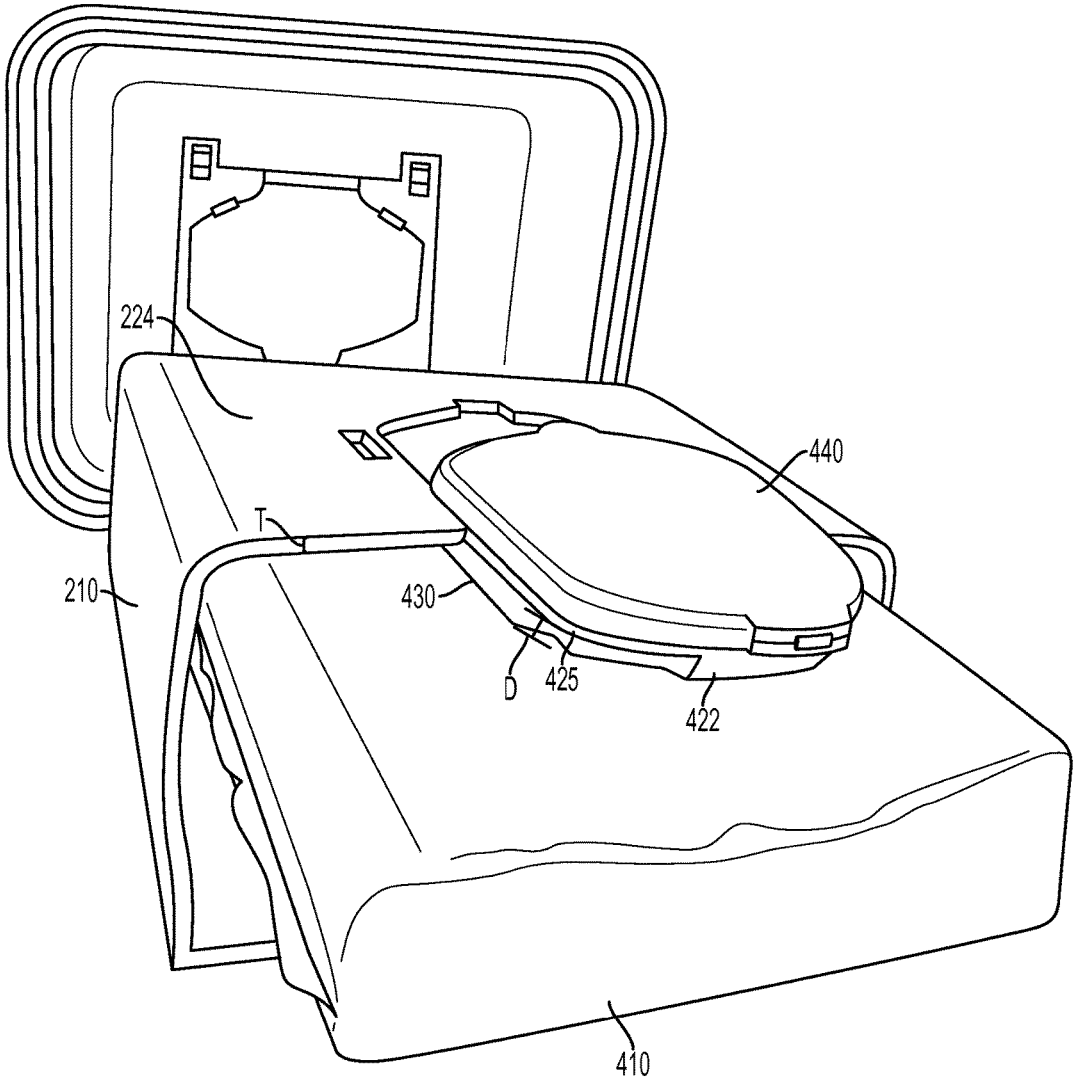
FIG. 10 is a top view of the integration device and container of FIG. 7, according to an embodiment of the disclosed subject matter.
Figure 11:
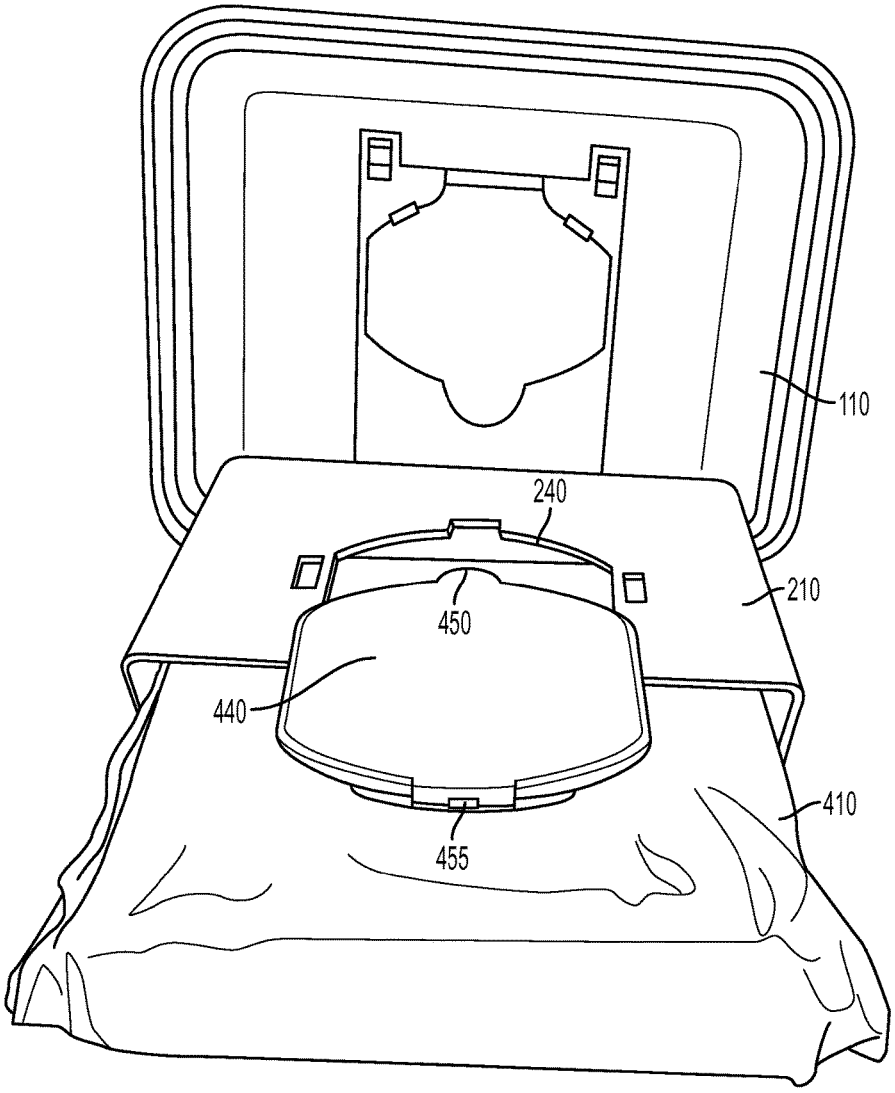
FIG. 11 is a top maximized view of the integration device and container of FIG. 10, according to an embodiment of the disclosed subject matter.
Figure 12:
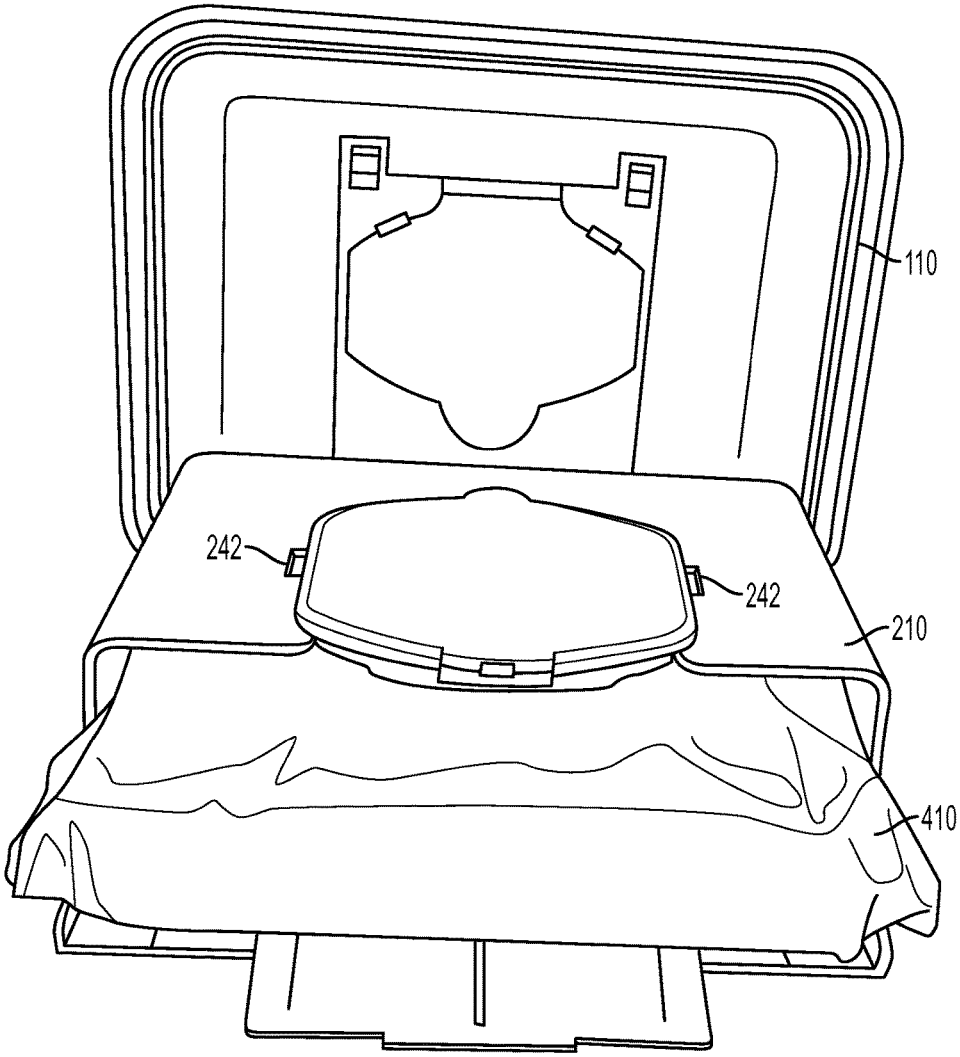
FIG. 12 is a top front view of the integration device and container of FIG. 7, according to an embodiment of the disclosed subject matter.

The bottom tray includes at least one upper tab 425 and at least one lower tab 430 distanced from the upper tab 425 at a distance D. The distance D can be any suitable distance such as ranging up to approximately 1 inch. The upper tab 425 and the lower tab 430 can together define a notch 433. The notch 433 permits a clearance for guides of the lid of the device to latch onto the top tray 440 of the cover 420, as further discussed herein. The distance D between tabs 425, 430 is greater than the thickness dimension T of the top segment 224 of the second member to permit the cover to be slid upon the top segment. FIG. 10 shows an example of a container 410 being inserted into the second member 210 such that the top segment 224 is received within the distance D of the cover 420. FIG. 11 is a top view of the integration device and container of FIG. 10 showing the container 410 inserted in the second member 210 with the finger tab 450 forward. FIG. 12 is a top front view of the container 410 slotted into the second member 210 for a snug fit at the border 240.

Figure 13:
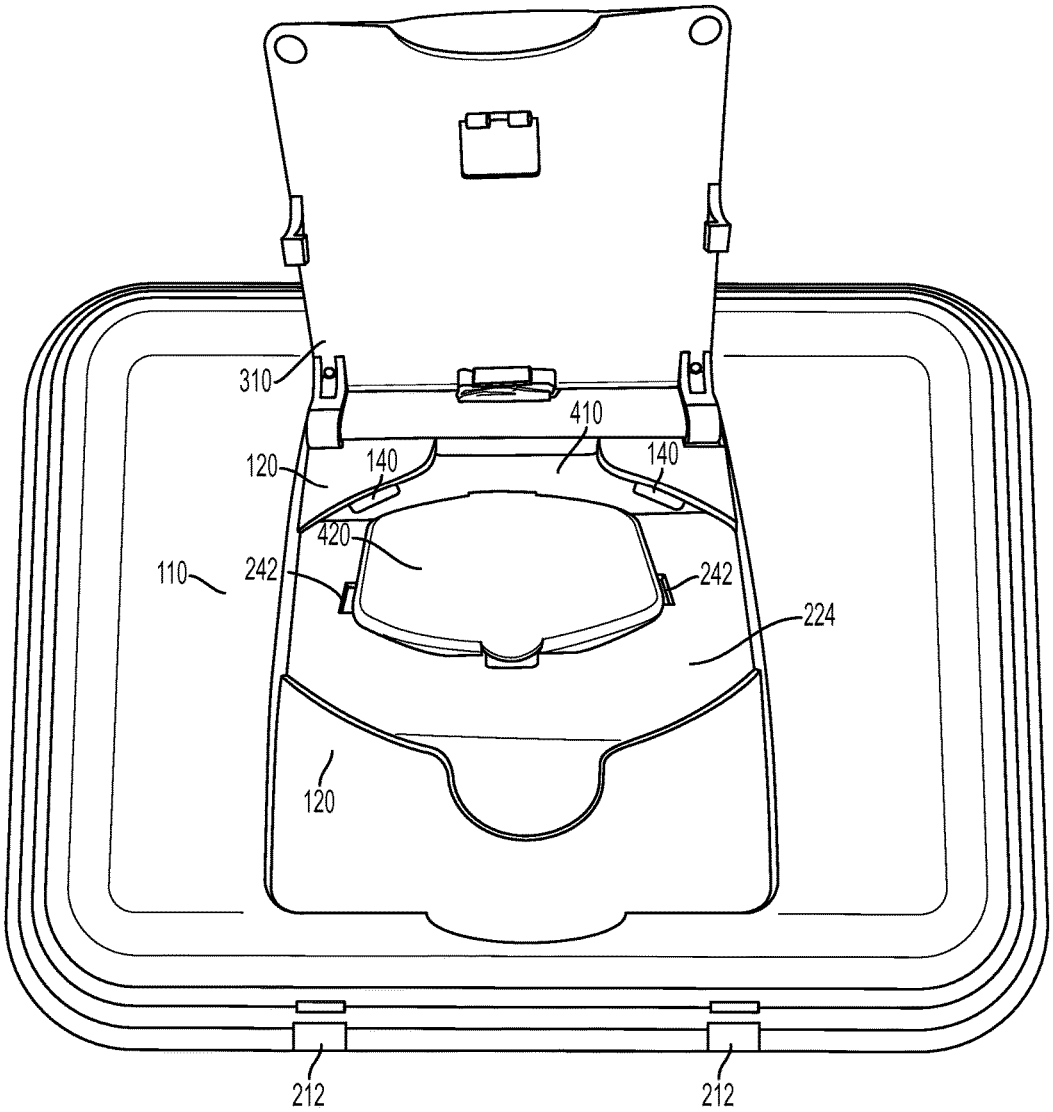
FIG. 13 is a top view of the second member with the container therein about to be coupled with the first member of FIG. 7, according to an embodiment of the disclosed subject matter.
Figure 14:
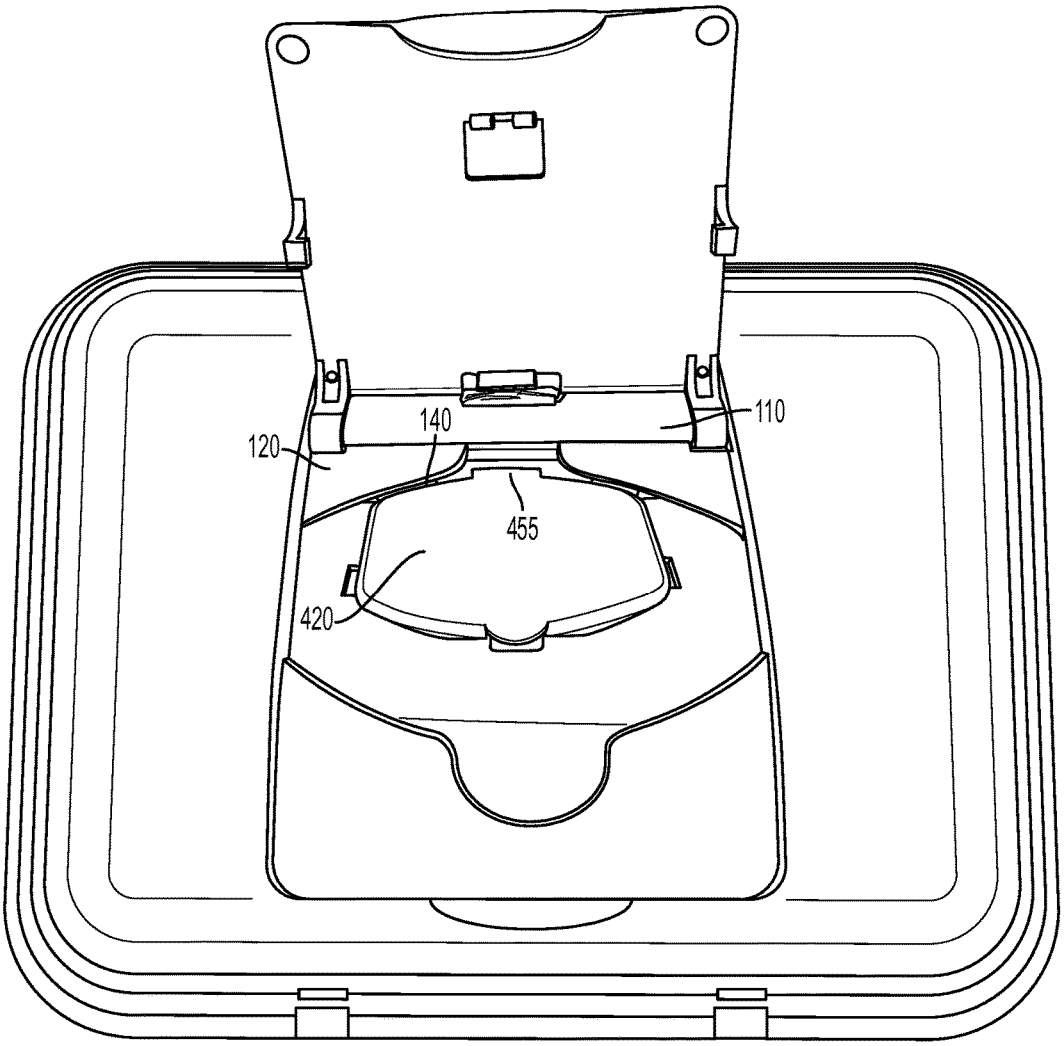
FIG. 14 is a detailed view of the connection between the integration device and the container of FIG. 13, according to an embodiment of the disclosed subject matter.
Figure 15:
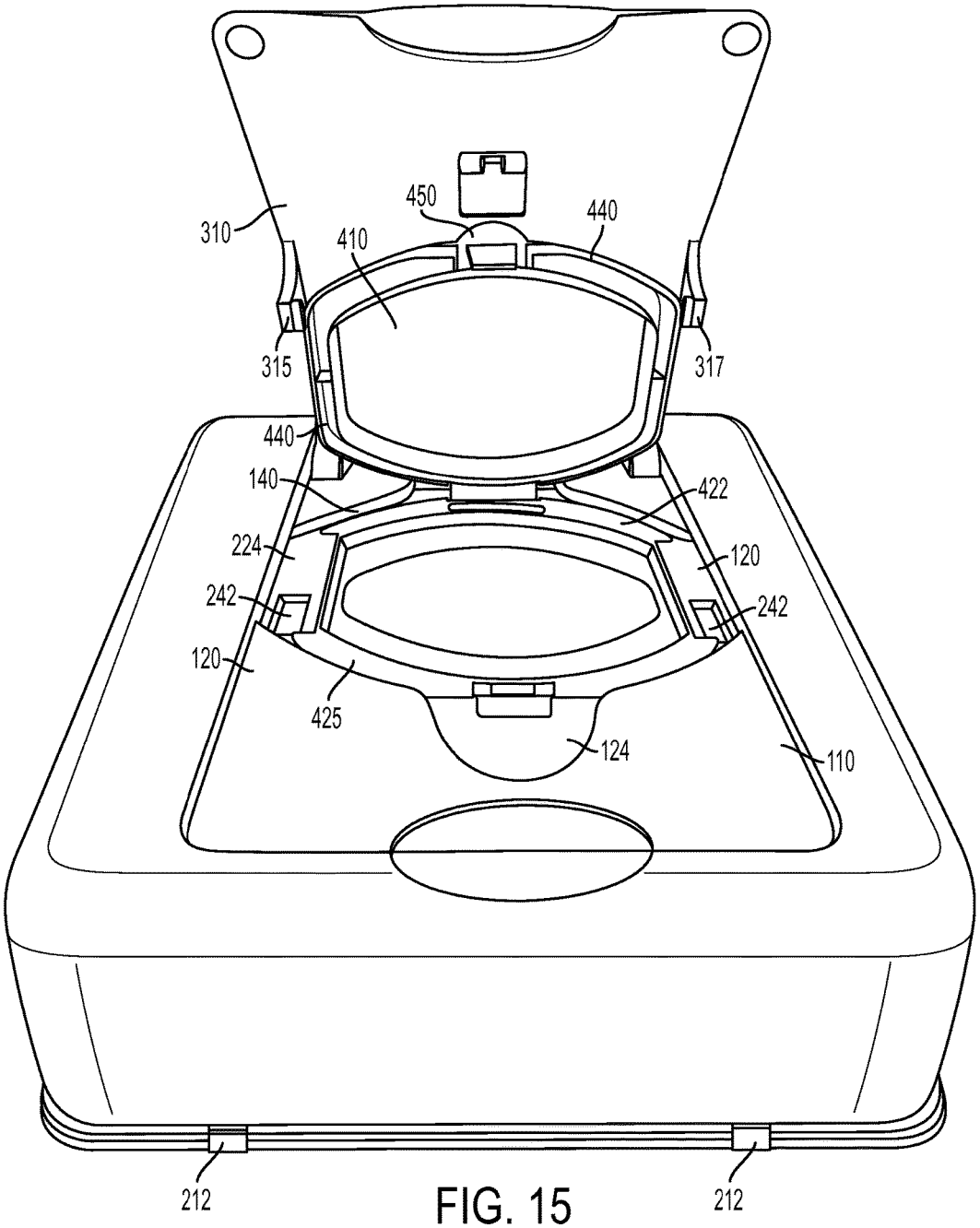
FIG. 15 is a top view of the integration device and container of FIG. 13, according to an embodiment of the disclosed subject matter.

After the container 410 is properly inserted into the top segment 224 of the second member 210, the first member 110 and the second member 210 can transition to the closed configuration. FIG. 13 is a top view of the second member 210 with the container 410 therein about to be coupled with the first member 110. As previously discussed, the first member 110 includes a lock device 140 to lock the first member 110 with the second member 210 in the closed configuration through the interfacing with the cover 420 of the container 410. FIG. 14 is a detailed view of the connection between the integration device locked with the container. As shown in FIG. 14, the first member 110 has been moved with respect to the second member 210 to lodge and dispose the flange of the locking device 140 below the bottom tray 422 of the cover 410. FIG. 15 is a top view of the integration device and container of FIG. 14 showing the first and second members 110, 210 coupled together with the cover 410 in the open position. Accordingly, the cover cooperates with the lock device to lock the first member with the second member in the closed configuration.

Figure 16:
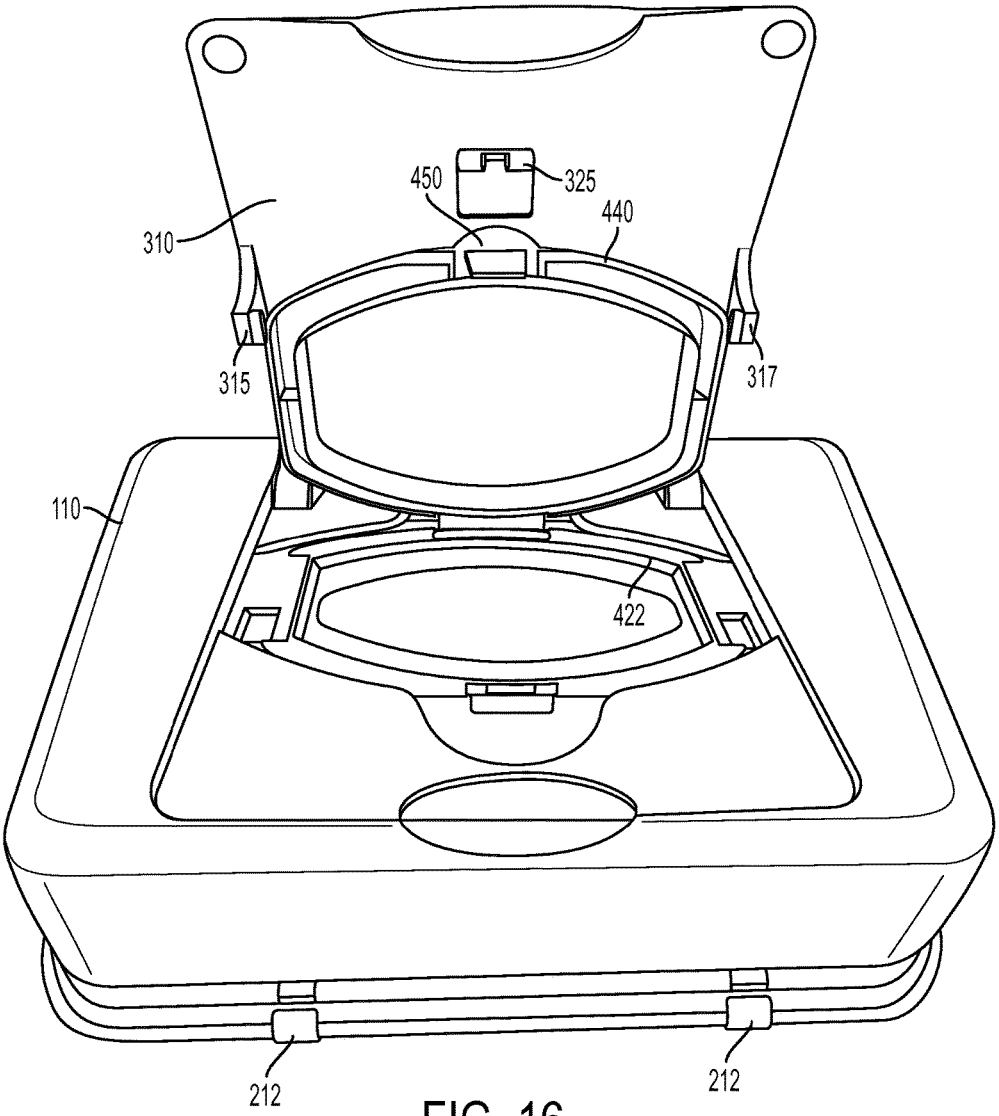
FIG. 16 is a top view of the integration device and container with an open cover of FIG. 1, according to an embodiment of the disclosed subject matter.

After the first member 110 and the second member 210 are coupled together in the closed configuration, the lid 310 can be moved to the closed position by exerting a force upon the lid 310 so that the lid engages the cover 410 and the lid 310 can be disposed flush with the top face 116 of the first member and housed within the recessed portion 120, as shown in FIG. 1. The lid 310 can additionally include a finger tab 350 to allow a finger to be inserted thereunder to facilitate opening of the lid 310. Likewise, the first member 110 can define an indentation 111 that complements the finger tab 350 as depicted in FIG. 1. FIG. 16 is a top view of the lid 310 coupled to the first member 110. The lid 310 comprises a first guide member 315 at a first side thereof and a second guide member 317 at a second side thereof. As shown, the first guide member 315 and the second guide member 317 couple with the top tray 440 of the cover 410 to transition the cover between the closed position and the open position. The first and second guide members 315, 317 respectively can each comprise a flange to engage the top tray 440 of the cover.

As depicted best in FIGS. 12 and 13, the second member 210 defines first and second apertures 242 to house the first and second guide members 315, 317 respectively. As such, the lid 310 can be housed flush or engaged with the top face 116 of the first member by permitting the first and second guide members 315, 317 a space to be inserted through the apertures 242. From the closed position, the first and second guide members 315, 317 respectively can exert a force on the top tray 440 of the cover 420 from below the top tray due to the notch 433, upon an upward force exerted to the lid 410.

Figure 17A:
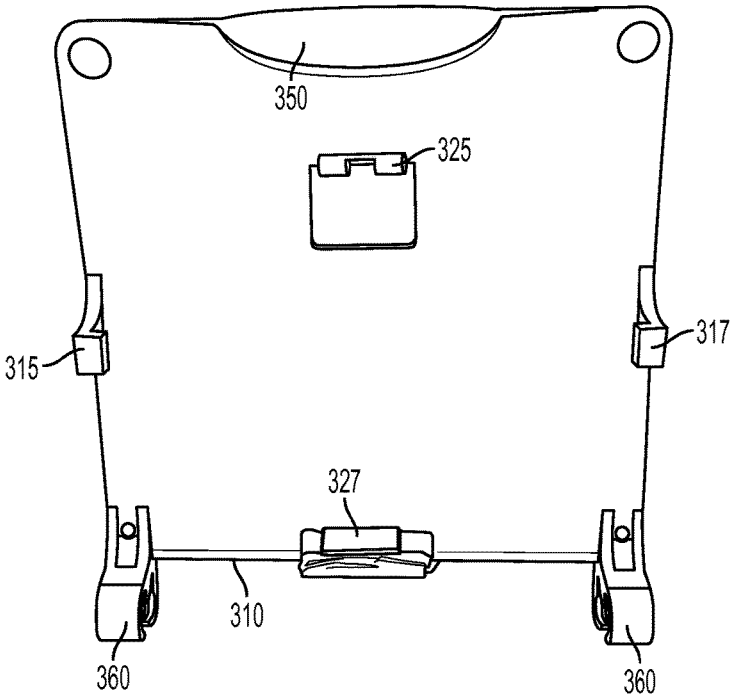
FIG. 17A depicts a lid, according to another embodiment of the disclosed subject matter.

FIG. 17A depicts a lid according to another embodiment of the disclosed subject matter. The lid 310 can additionally and optionally comprise a third guide member 325 to engage a finger tab 450 of the cover. The engagement of the third guide member 325 can exert a force on the finger tab 450 to disengage the locking of the clasp 445 of top tray 440 with the ridge 435 of bottom tray 422 prior to guide members 315, 317 coming into contact with the top tray 440. As such, the third guide member 325 can secondarily guide the top tray 440 through the opening movement until the guide members 315, 317 contact the top tray. As opening of the top tray further continues, the third guide member 325 disengages with the top tray. During closing operations of the top tray 440, the third guide member 325 reengages with the finger tab 450 under the guidance of guide members 315, 317.

Figure 17B:
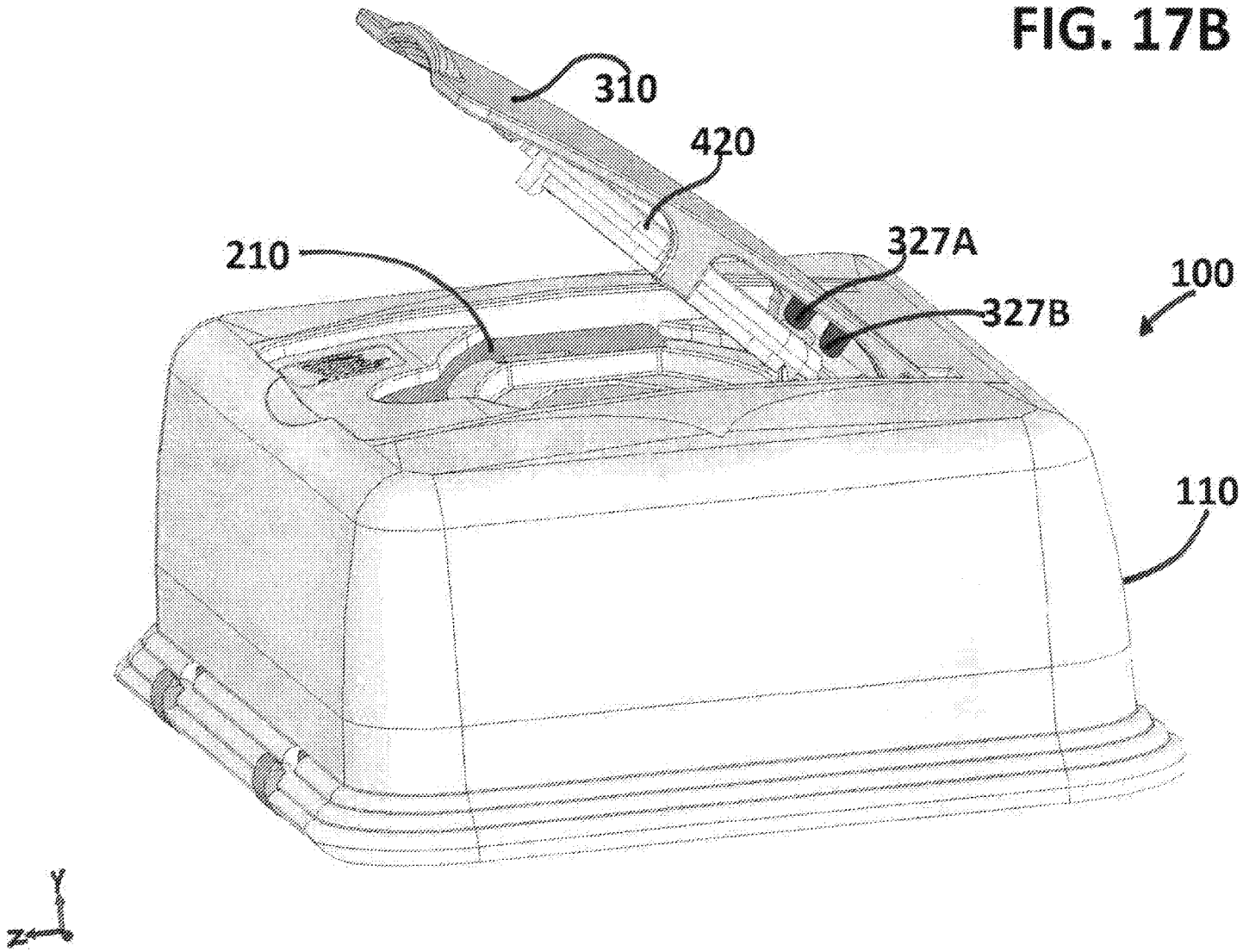
FIG. 17B depicts a side perspective view of an integration device, according to another embodiment of the disclosed subject matter.
Figure 17C:
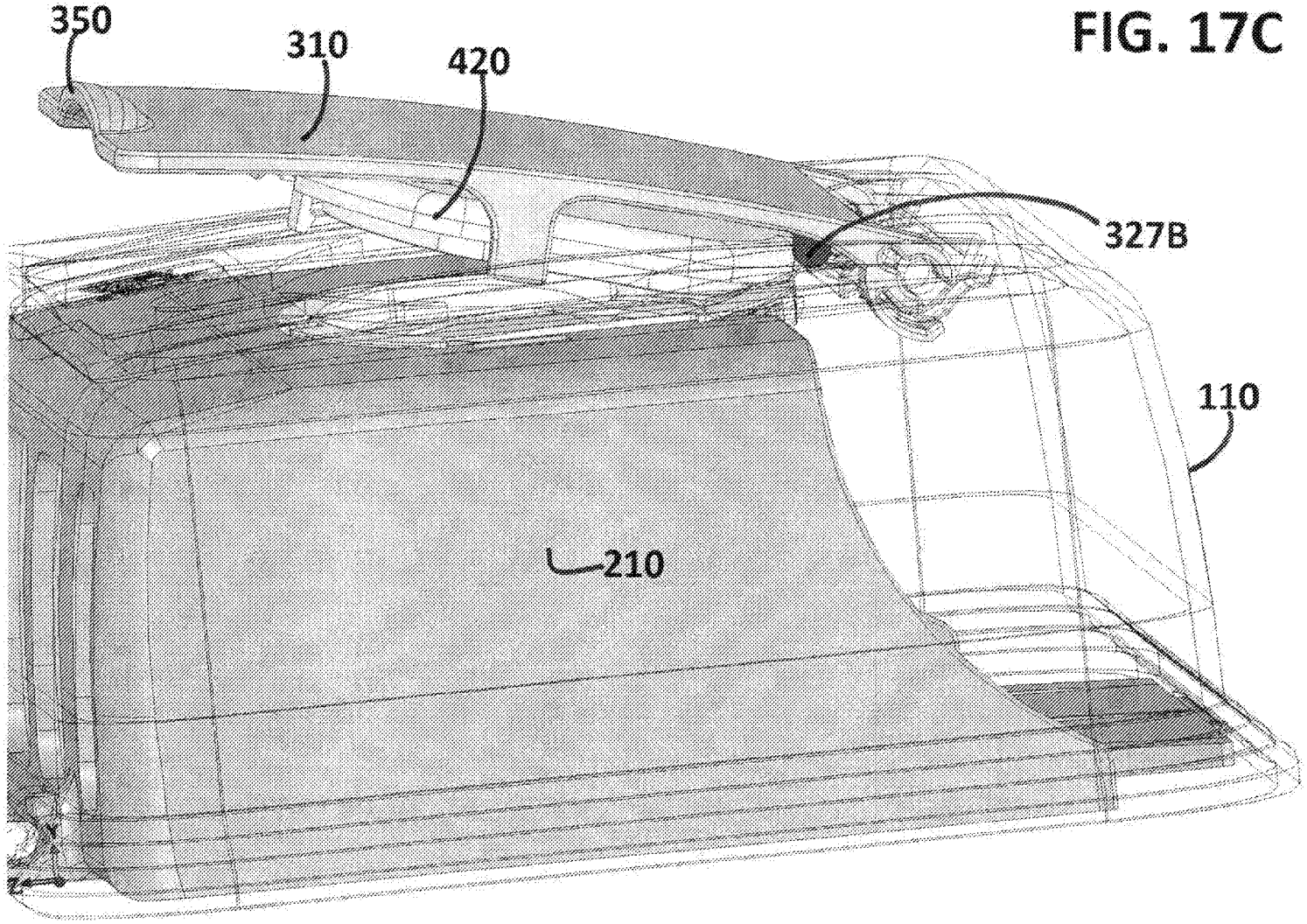
FIG. 17C is a side perspective view of the device of FIG. 17B with a first member in phantom, according to the disclosed subject matter.

As depicted in FIG. 17A, a fourth guide member 327 can further be provided to engage a back of the cover. The fourth guide member 327 can include one component as shown or can include more than one component. FIG. 17B depicts another embodiment of the device having a lid 310 with a fourth guide member having two components 327A, 327B. The two components 327A, 327B are engagable with the back of the cover 420 of the container 410. FIG. 17B depicts the lid 310 and cover 420 ajar such that the components 327A, 327B have not yet engaged the back of the cover 420 of the container 410. FIG. 17C depicts the device of FIG. 17B in a perspective side view with the first member 110 in phantom to depict the engagement of the lid 310 with the cover 420. As shown in FIG. 17C, the lid 310 is further closed to enable the components 327A, 327B to engage the back of the cover (327A not shown in FIG. 17C). The fourth guide member 327 provides a better securement of the cover of the container with the device. As shown, the lid can also include a finger tab 350.

Figure 18:
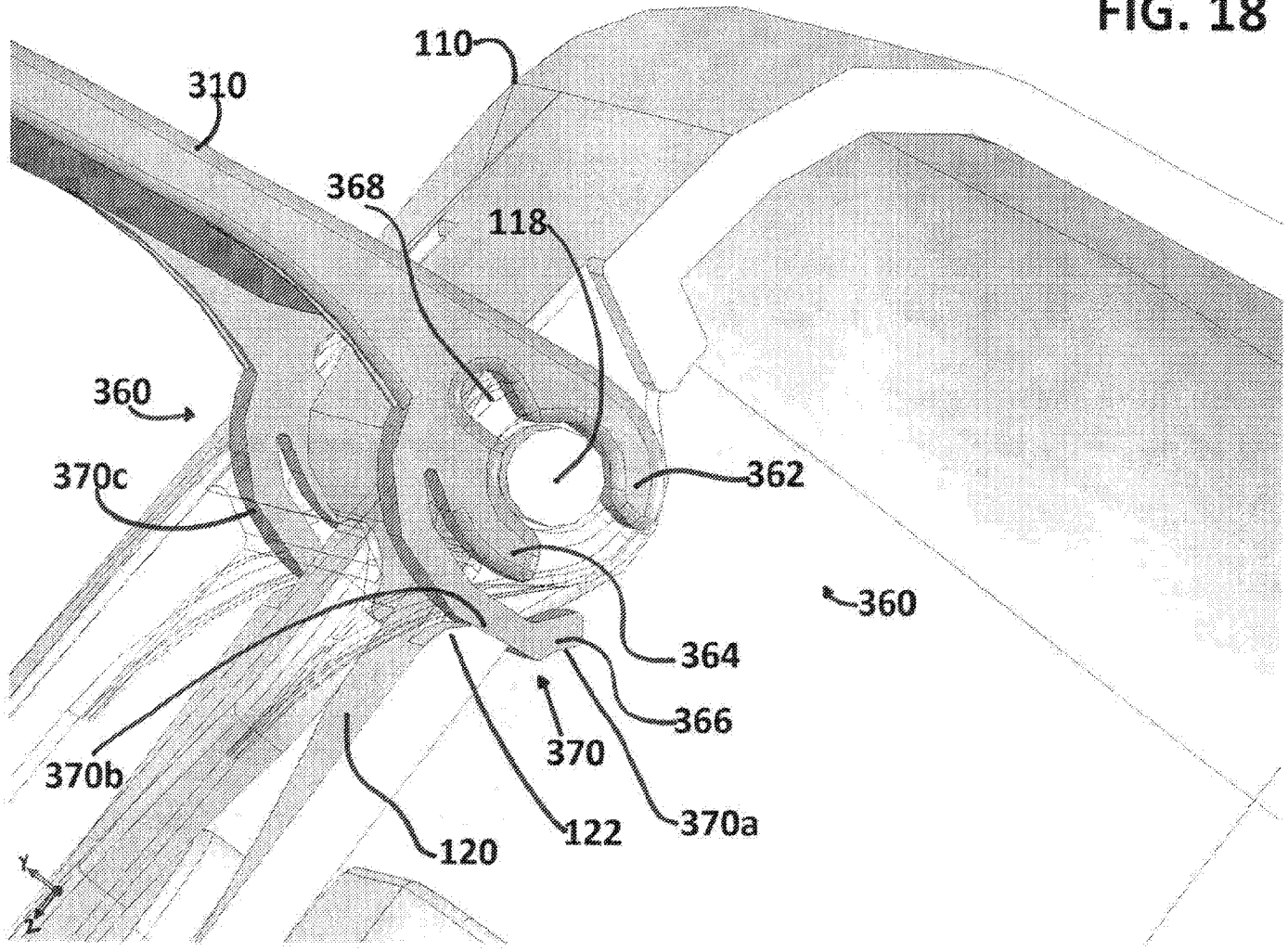
FIG. 18 is a side view of the securement structure of the integration device, according to an embodiment of the disclosed subject matter.
Figure 19:
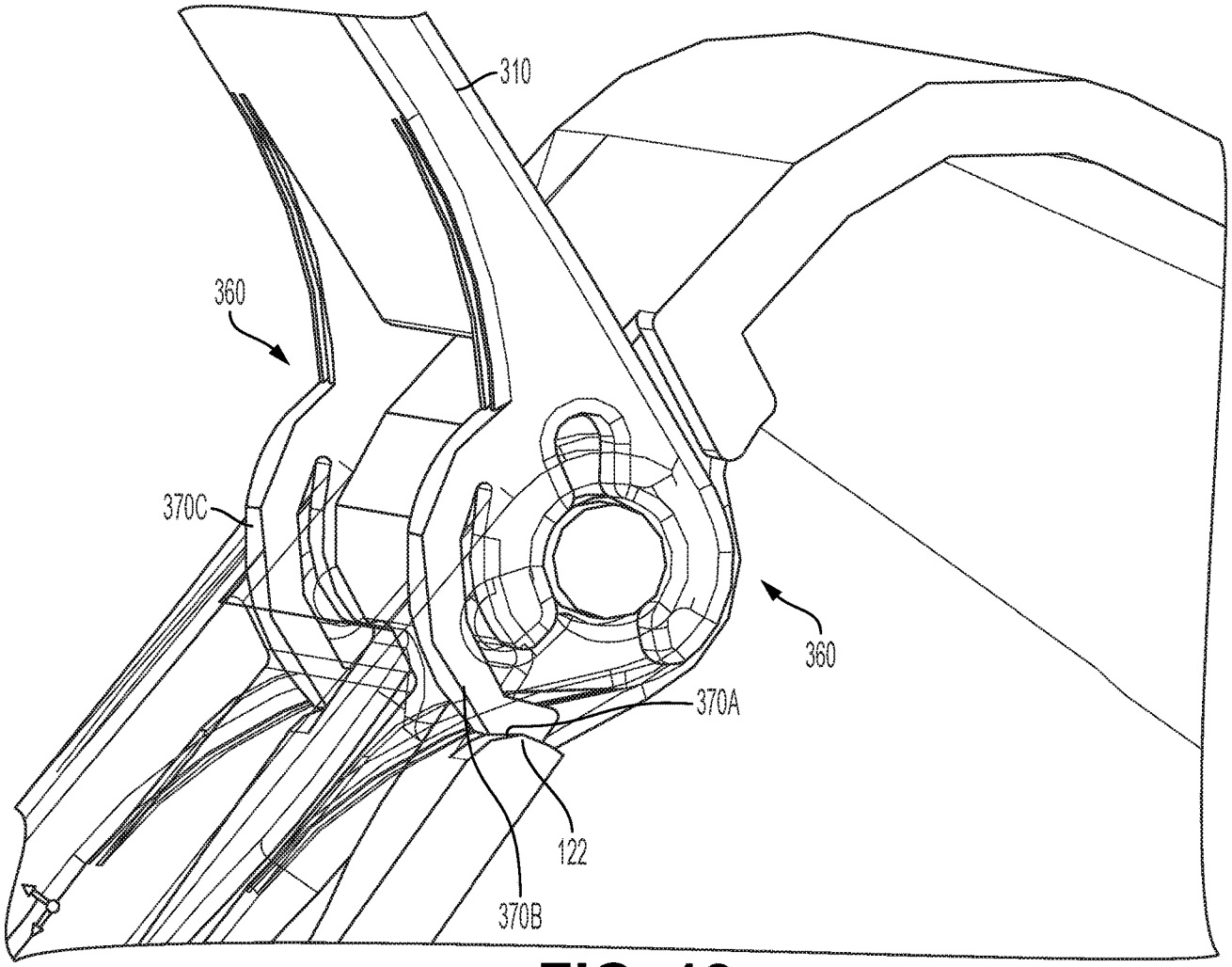
FIG. 19 is a second side view of the securement structure of the integration device of FIG. 18, according to an embodiment of the disclosed subject matter.

The lid can be coupled to the first member by at least one securement structure. FIG. 18 and FIG. 19 are side views of the at least one securement structure 360 coupled to a bar 118 of the first member 110. The securement structure 360 can include a first and second securement finger 362, 364 couplable to the first member 110 at the bar 118. The securement structure 360 can include a recess 368 disposed between the first securement finger 362 and the second securement finger 364 to impart flexibility to the securement structure 360. An abutment finger 366 is spaced from the first and second securement fingers 362, 364 and engages a ledge 122 of the recessed portion 120 of the first member. The abutment finger includes a cam section 370 that engages the ledge 122 of the recessed portion 120 of the first member 110. As such, different portions (370*a*-370*c*) of the cam section 370 can correspond to different open positions of the lid 310. Accordingly, depending on which portion 370*a*-370*c* is engaged with the ledge 122, the lid 310 will be in a corresponding position. For example, FIG. 18 depicts the portion 370*b* engaged with the ledge 122 of the first member which corresponds to a first angle of the lid open with respect to the first member. FIG. 19 depicts the portion 370*a* engaged with the ledge 122 of the first member which corresponds to a second angle of the lid open with respect to the first member such that the second angle is greater than the first angle. The cam section 370 also permits the lid 310 to maintain static open positions independently without the lid collapsing toward the first member. As such, the lid 310 can be kept open without a consumer having to engage the lid 310. The embodiment of FIG. 18 and FIG. 19 depicts two securement structures 360, however, any number of securement structure(s) is contemplated herein. When the lid is fully extended, such as for example when the ledge 122 is engaged with portion 370*a* of the lid, the guides 315, 317 of the lid 310 disengaged from the cover of the container 410, as discussed below. The lid can be fully extended at any suitable angle, such as for example, up to approximately 180°.

Figure 20:
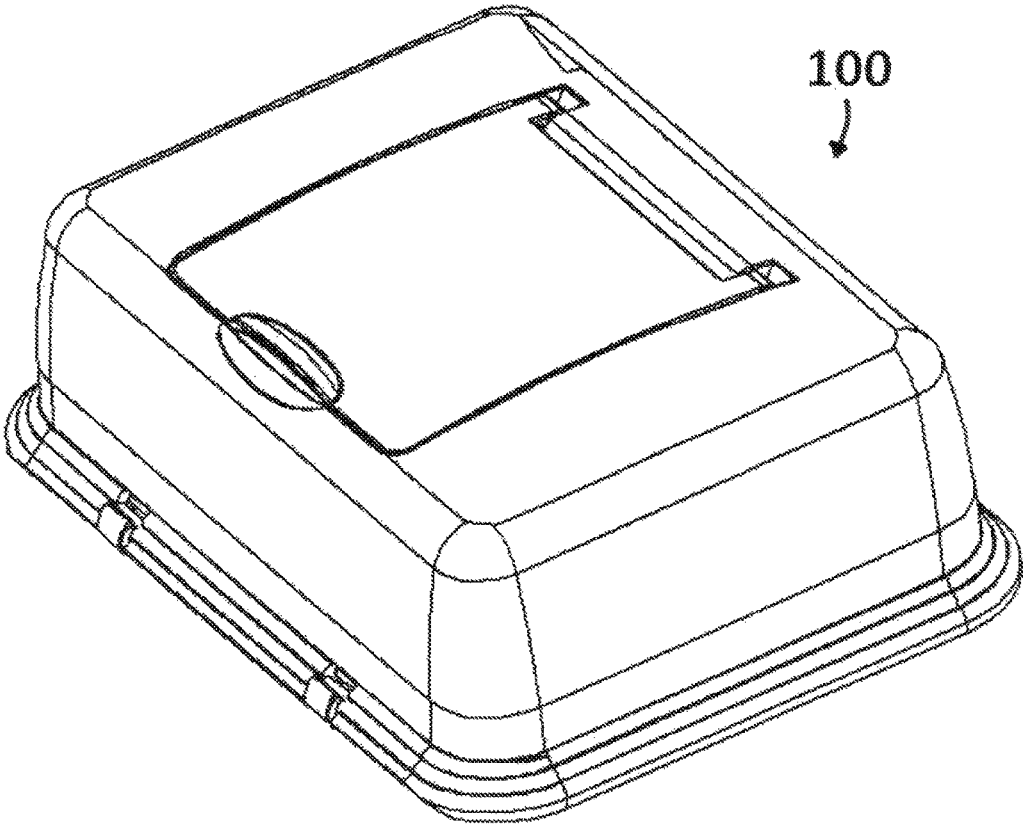
FIGS. 20-26 depict perspective views of the integration device with a container therein transitioning from the closed configuration to the open configuration, according to an embodiment of the disclosed subject matter.
Figure 21:
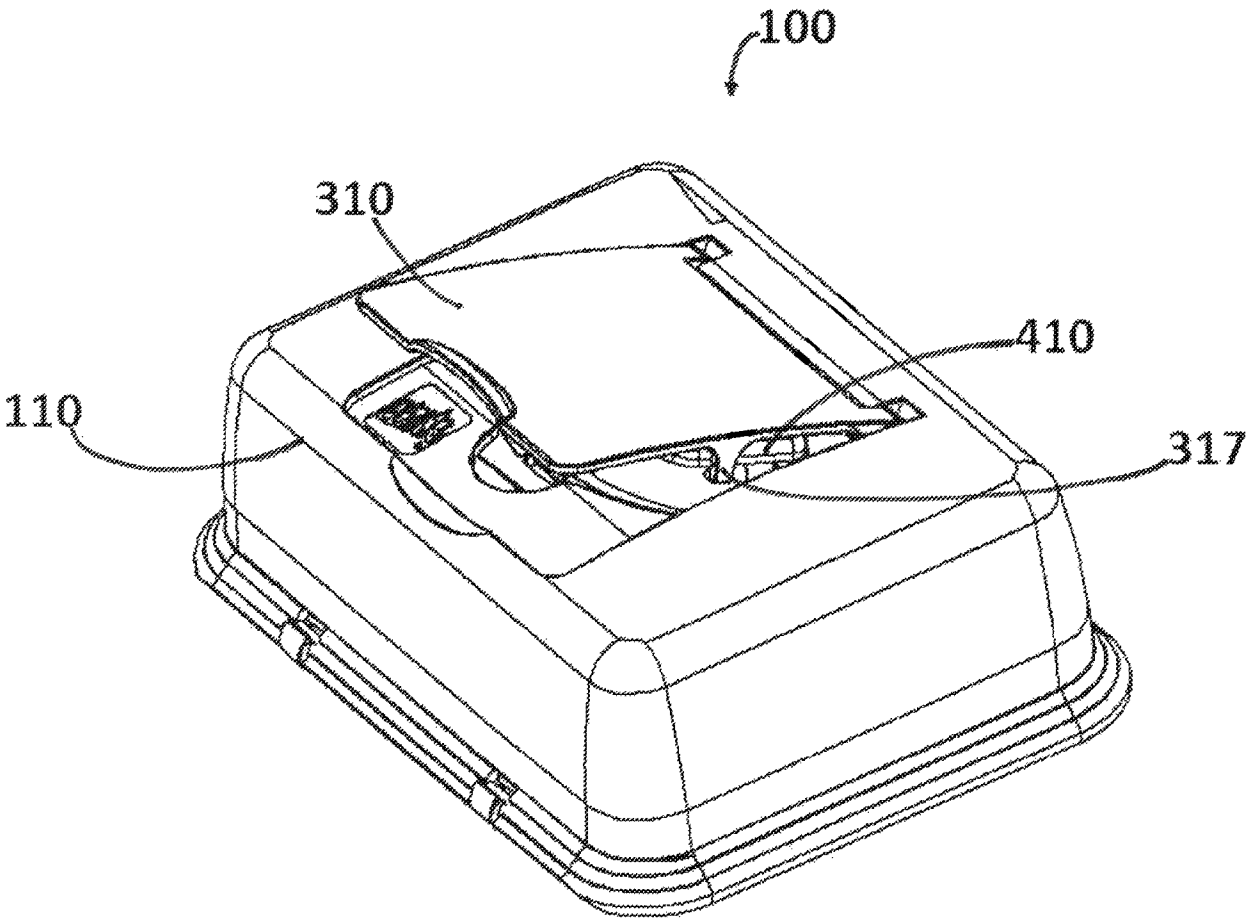
Figure 22:
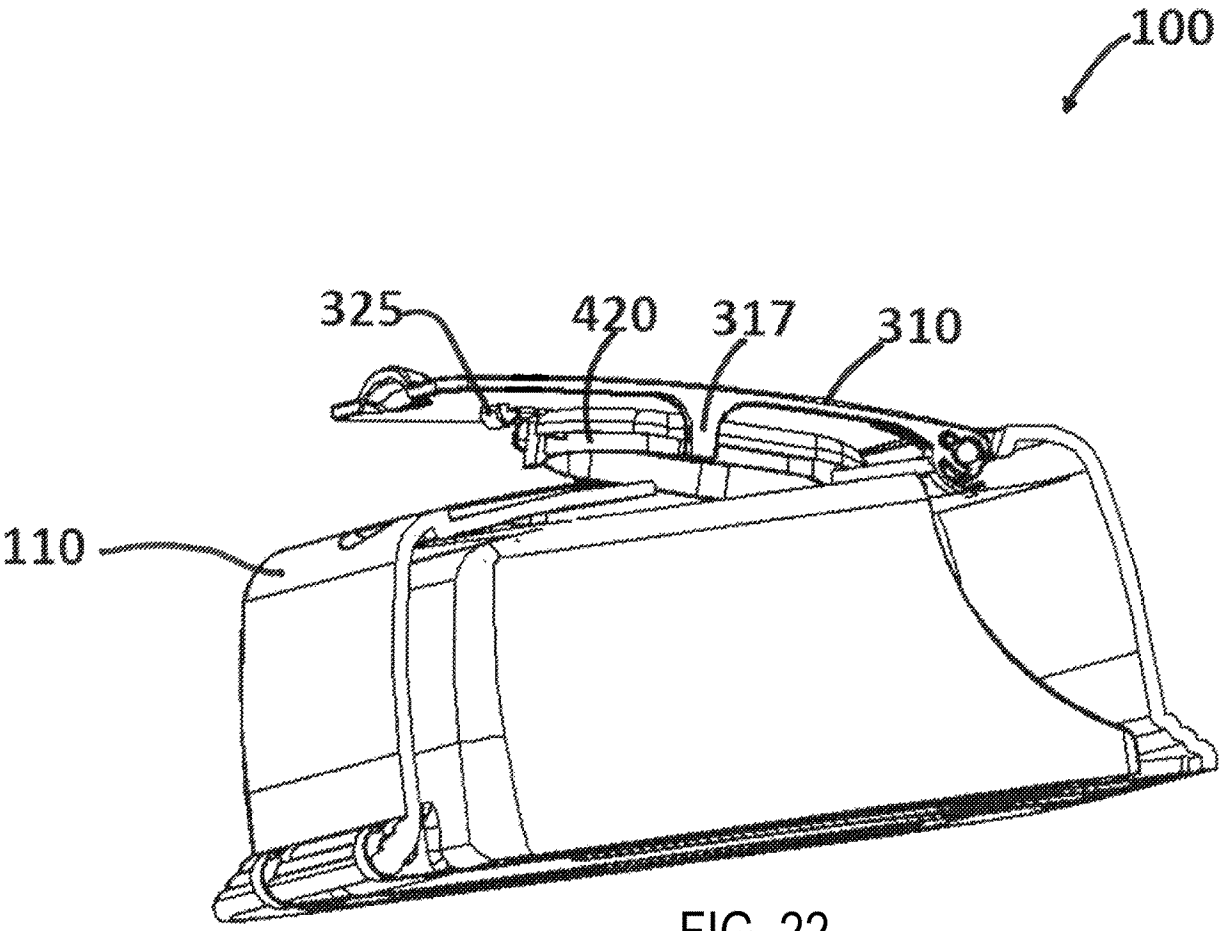
Figure 23:
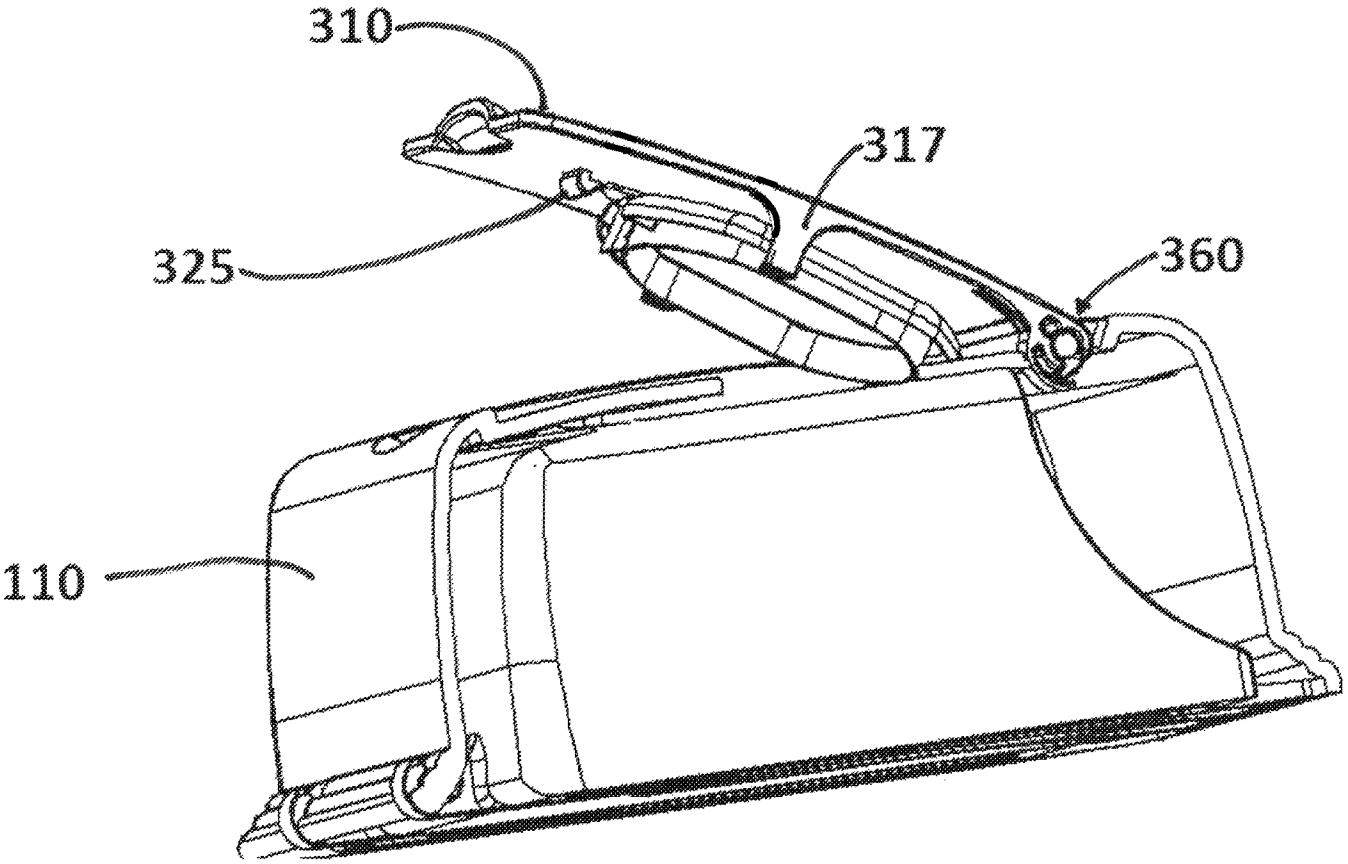
Figure 24:
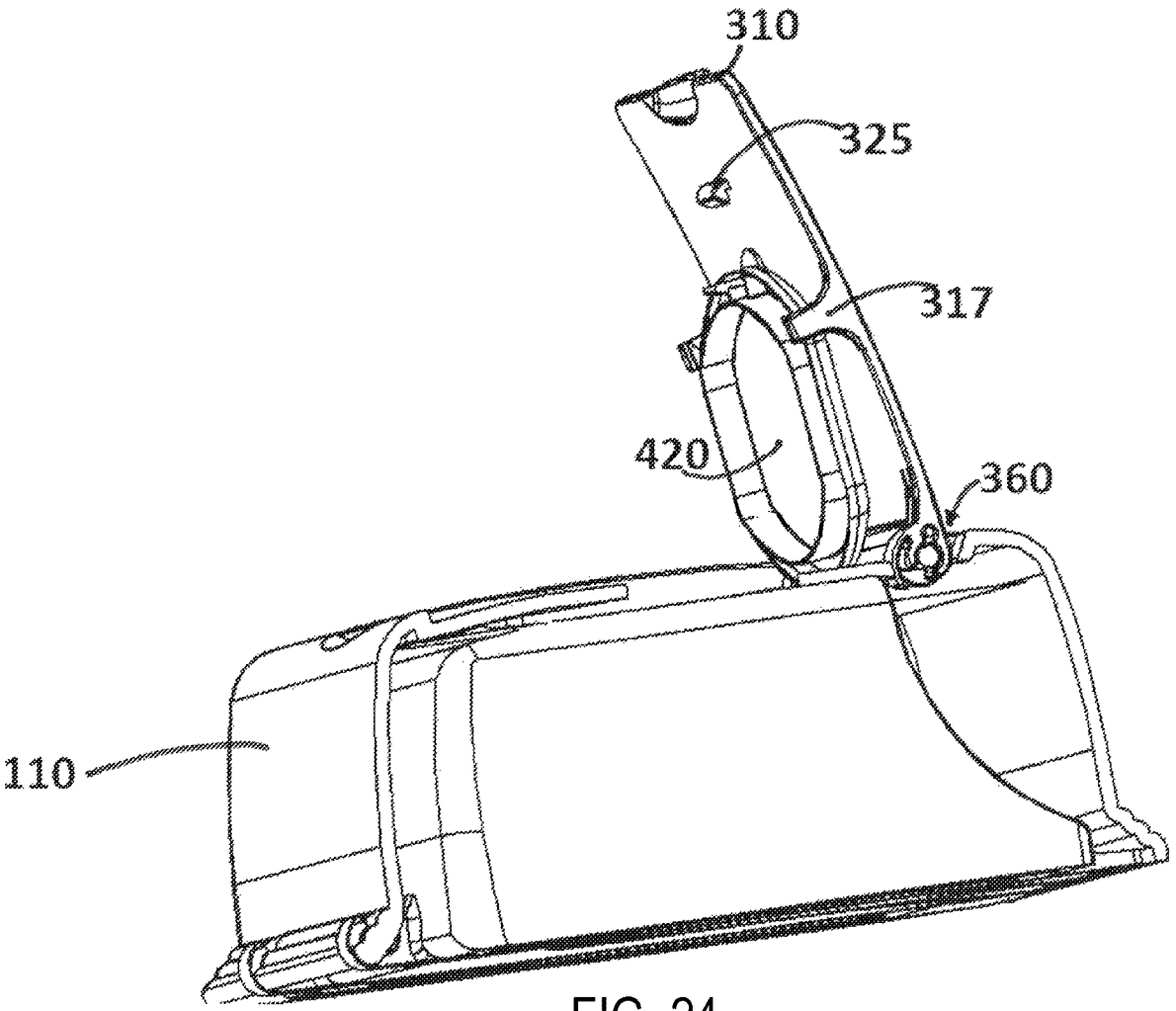
Figure 25:
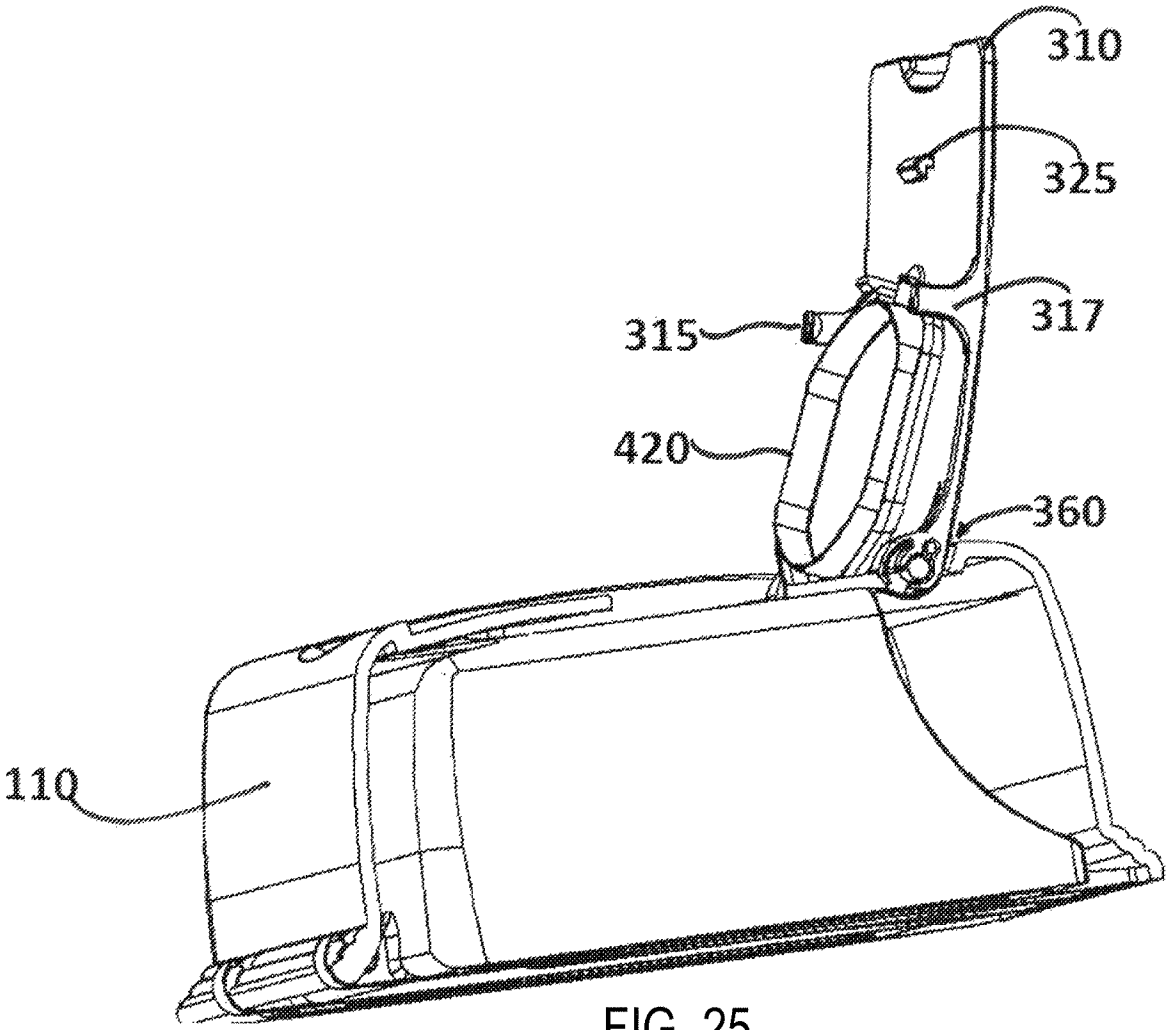
Figure 26:
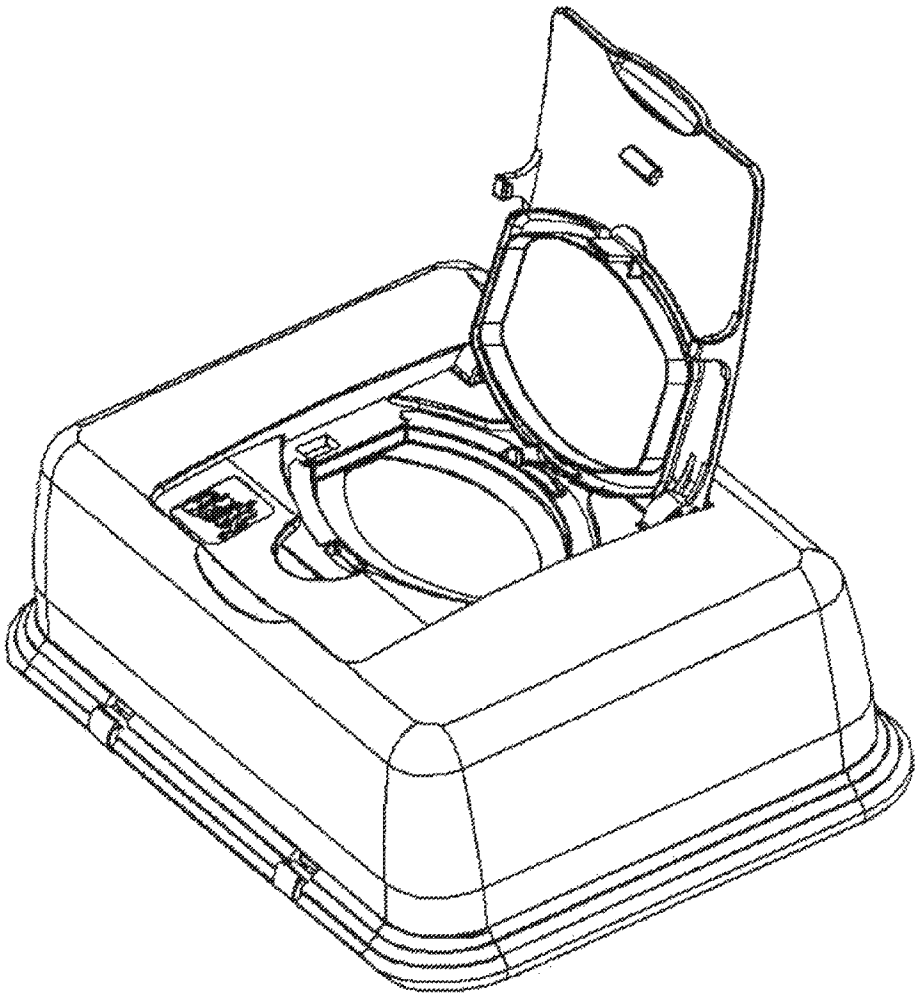

FIGS. 20-26 depict perspective views of the integration device with a container therein, transitioning from the closed configuration to the open configuration, according to another embodiment of the disclosed subject matter. FIG. 20 depicts the device 100 in the closed configuration. FIGS. 21 and 22 depict the lid 310 partially open with the guide 317 engaged with the cover 410 of the container therein. In FIG. 22, the partially open position additionally shows the engagement of the third guide 325 with the tab 450 of the cover 420. FIG. 23 shows another open position of the lid 310 with the third guide 325 no longer interfacing with the finger tab 450. FIG. 24 shows a further extension of the lid moving toward the fully open position, wherein the securement structure 360 is engaging the first member to permit the lid to support itself independent of the cover 420. FIGS. 25 and 26 depict the fully open position of the lid such that the guides 317, 315, 325 are no longer in engagement with the cover 420 and the lid supports itself fully opened by way of the securement structure 360. Furthermore, the hinge of the cover props open the cover independently in this configuration.

FIGS. 27A-27E depict perspective views of steps to mount a device and to insert a container into the device, according to an embodiment of the disclosed subject matter.

Figure 27B:
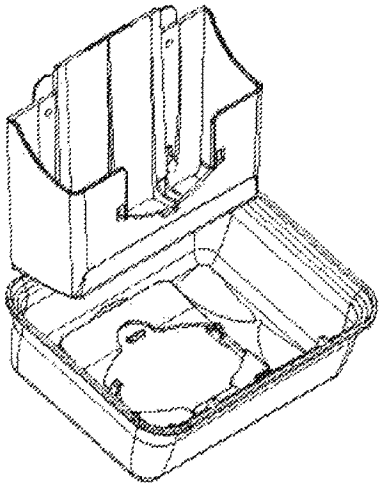
FIGS. 27A-27E depict perspective views of steps to mount a device and inserting a container into the device, according to an embodiment of the disclosed subject matter.
Figure 27E:
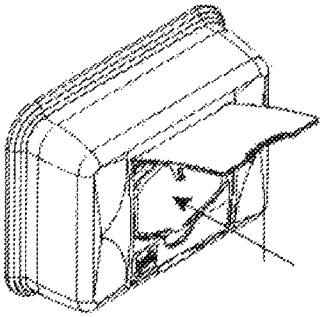
Figure 27A:
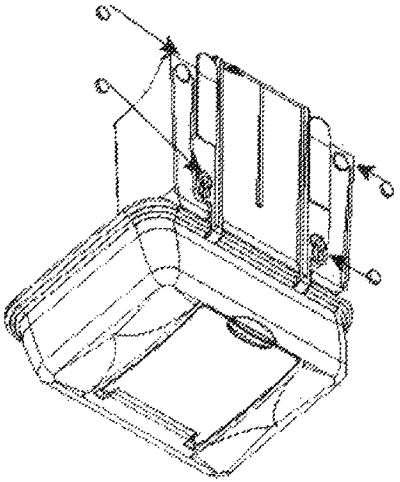
Figure 27D:
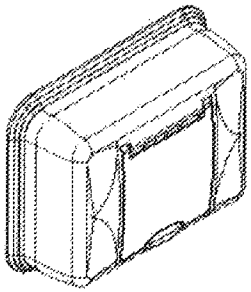
Figure 27C:
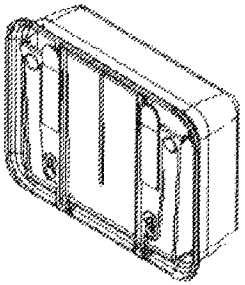

FIG. 27A depicts where suitable screws are insertable into recesses of the device and depicts utilizing adhesive strips as indicated to mount the device. Alternatively, the device can be used standing on a surface and foam feet can be applied to the device as shown. FIG. 27B shows a suitable configuration for using the device as mounted to a wall. FIGS. 27C and 27D show back and front perspective views of the device of FIG. 27B in the closed configuration. FIG. 27E depicts where a force can be exerted to open the device to enable the refilling of the device with a refill container.

Figure 28B:
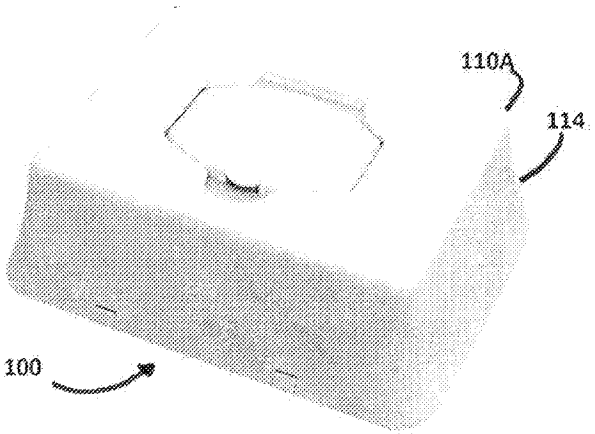
FIGS. 28A-28D depict perspective views of further embodiments of the integration device, according to the disclosed subject matter.
Figure 28A:
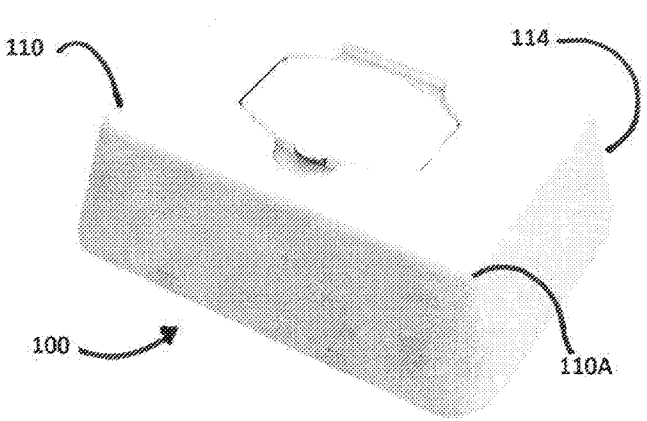
Figure 28D:
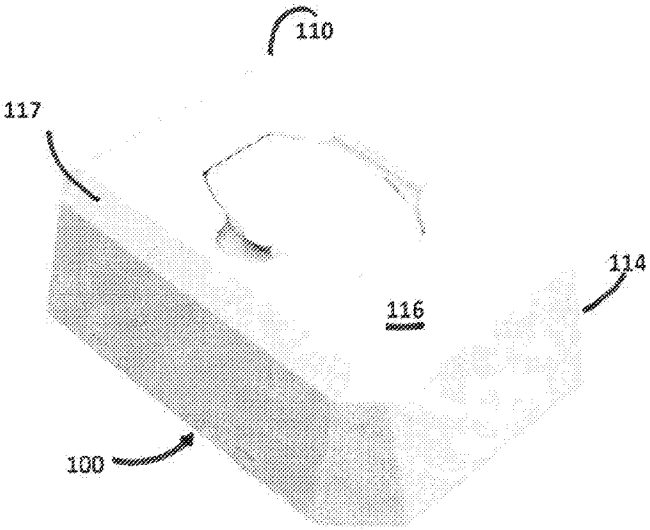
Figure 28C:
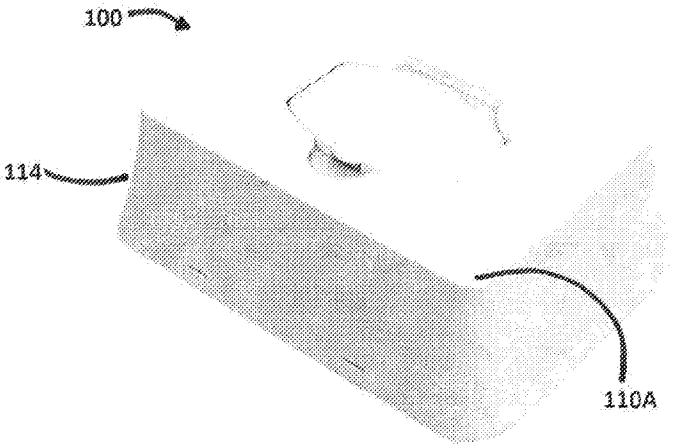

FIGS. 28A-28D depict perspective views of further embodiments of the integration device 100, according to the disclosed subject matter. FIG. 28A depicts the first member 110 having rounded corners 110A with substantially linear sidewalls 114. FIG. 28B depicts the first member 110 having rounded corners 110A but with curved sidewalls 114. FIG. 28C depicts the first member 110 having sharp or angular corners 110A with curved sidewalls 114. FIG. 28D depicts the first member 110 having sharp or angular corners and a ledge 117 disposed between the face 116 and the straight edge sidewalls 114.

Figure 29A:
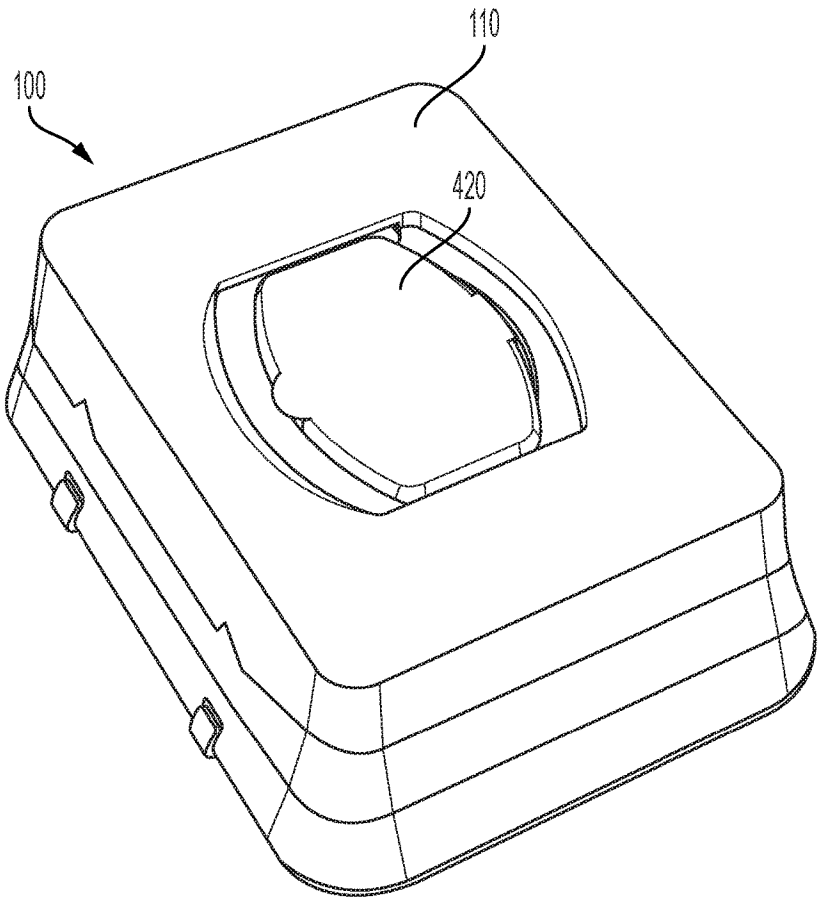
FIGS. 29A and 29B depict an alternative embodiment of the integration device without a lid, according to the disclosed subject matter.
Figure 29B:
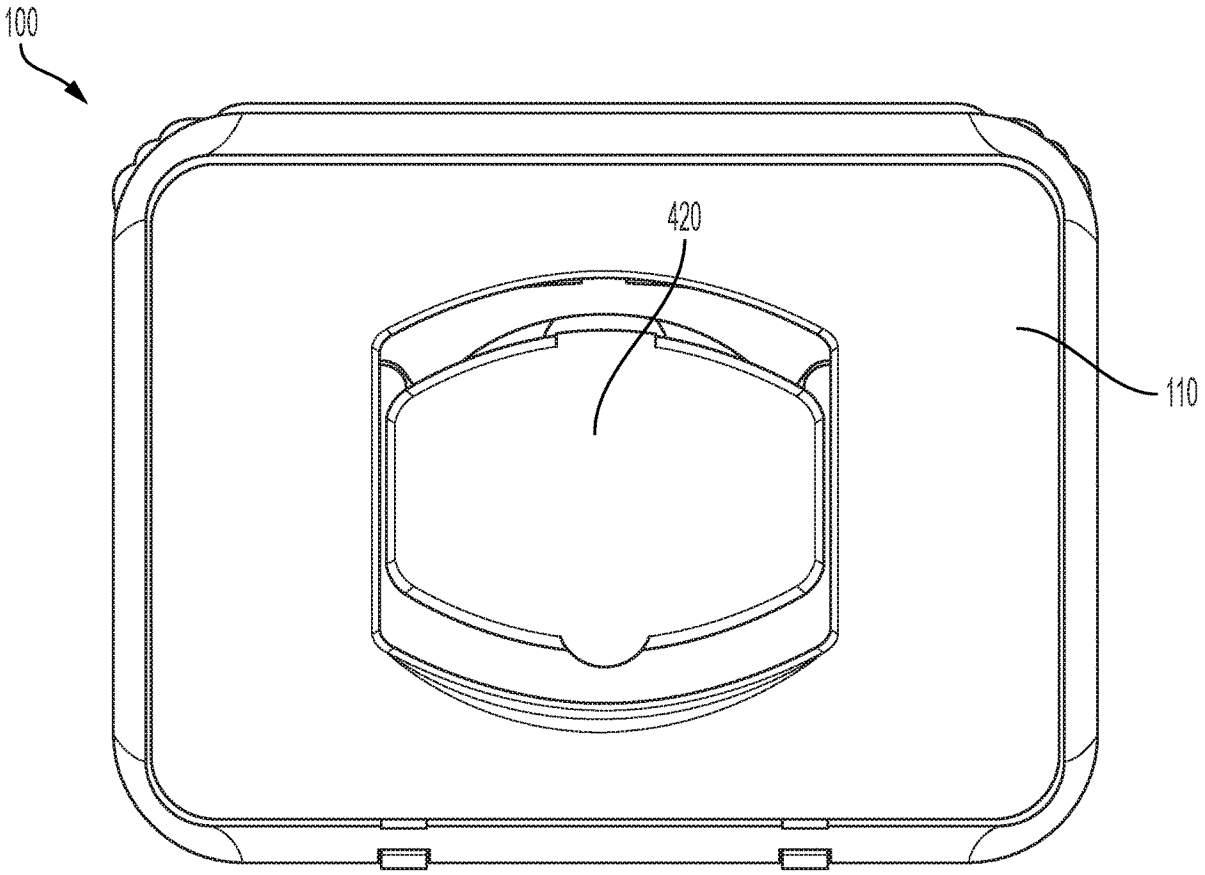

FIGS. 29A and 29B depict an alternative embodiment of the integration device, according to the disclosed subject matter. FIG. 29A is a perspective view and FIG. 29B is a plan view. In this embodiment, the top tray 420 of the container 410 is outwardly exposed rather than protected by a lid as previously described. Accordingly, the integration device 100 of this embodiment does not include the structure devices needed to enable a lid to be coupled to the first member. As such, the top tray 420 is readily accessible and independently transitionable between a closed and open position.

The device 100, including any of the first member, second member, and lid, can be made of any suitable material to enable the device to function as described herein. For example, the device can be made of a polymer, copolymer or resin, such as HDPE—High Density Polyethylene, LDPE—Low Density Polyethylene, LLDPE—Linear low-density polyethylene, PS—Polystyrene, PVC—Polyvinyl chloride, PP—Polypropylene, ABS—Acrylonitrile butadiene styrene, PET or PETE—Polyethylene terephthalate, PC—Polycarbonate, SAN—Styrene acrylonitrile, POM—Polyoxymethylene, Acrylic, Nylon, and combinations or blends thereof. Furthermore, the device or components of the device can comprise metal, glass or ceramic. The first member, second member, and lid can be made of the same material or can be made of different material.

The device can be constructed by any suitable method. Examples of such methods includes, but is not limited to, overmolding, injection molding, thermoforming, compression molding, transfer molding, machining, additive manufacturing/three dimensional printing, and the like and other suitable methods are contemplated herein.

The device can be any color, or a plurality of colors. The device can furthermore include patterns and texture to be more aesthetically pleasing to consumers. The texture processing can include engraving, embossing, and debossing. The device can furthermore be plated, coated, and painted. For example, the device can be plated by electroplating, electroless plating, and vacuum deposition with metals or mixtures thereof or with any other suitable material compatible with such processes. The device can further undergo post plating processes such as, but not limited to, artificial aging such as applying a brown patina to bronze, polishing, brushing, media blasting, tarnishing or combinations thereof. The device can further be coated such as with clear or tinted coatings as known in the industry. The device can also be painted, coated with polymers, sprayed, and dipped. The device can additionally include in mold labeling, adhesive labeling, hot stamping, printing, and water transfer films.

The container can include any articles therein that can be dispensed. Examples of suitable articles include wipes, tissues such as moist toilet tissue or dry tissues, facial pads, nonwoven materials, woven materials, and the like. As such, the article can by dry, moist, or wet and include lotions, chemical formulations, and the like.

While the disclosed subject matter is described herein in terms of certain preferred embodiments and representative examples, those skilled in the art will recognize that various modifications and improvements can be made to the disclosed subject matter without departing from the scope thereof. Additional features known in the art likewise can be incorporated. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Furthermore, although reference is made to a system for integrating a container with a device throughout this disclosure, other suitable container-like apparatuses can be integrated using the system and method disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the system and method of the disclosed subject matter without departing from the spirit or scope of the disclosed subject matter. Thus, it is intended that the disclosed subject matter include modifications and variations that are within the scope of the appended claims and their equivalents.

What is claimed is:

1. An integration device, comprising:

a first member having a lock device;

a second member coupled to the first member, wherein the second member receives a container therein having a cover, the first member being movable with respect to the second member between an open configuration and a closed configuration, wherein the cover cooperates with the lock device to lock the first member with the second member in the closed configuration; and a lid coupled to the first member, wherein the lid is engageable with a top tray of the cover to transition the cover between a closed position and an open position, and wherein the lid comprises a first guide member at a first side thereof and a second guide member at a second side thereof, and wherein the first guide member and the second guide member couple with the top tray of the cover to transition the cover between the closed position and the open position, and wherein the first and second guide members respectively are housed within first and second apertures of the second member.

2. The integration device of claim 1, wherein a top face of the first member comprises at least one recessed portion, wherein the lid is housed in the recessed portion in the closed position.

3. The integration device of claim 2, wherein the recessed portion defines an aperture to receive the top tray of the cover.

4. The integration device of claim 1, wherein the lock device of the first member comprises at least one flange, wherein the at least one flange is disposed below a bottom tray of the cover to lock the first member with the second member in the closed configuration.

5. The integration device of claim 1, wherein the first member and second member are pivotably coupled together.

6. The integration device of claim 1, wherein the second member defines an interior that houses the container.

7. The integration device of claim 1, wherein the second member defines a top segment, a bottom segment, first and second sidewalls, and a back segment.

8. The integration device of claim 7, wherein the top segment of the second member comprises a border that complements a shape of the cover of the container.

9. The integration device of claim 1, wherein the second member comprises a thickness dimension, wherein the thickness dimension of the second member is less than a height between an upper tab and lower tab of the cover.

10. The integration device of claim 1, wherein the second member is housable within the first member.

11. The integration device of claim 7, wherein an inner surface of the bottom segment includes sections having different contours and thicknesses.

12. The integration device of claim 11, wherein the sections encourage the container to shift toward the top segment of the second member.

13. The integration device of claim 7, wherein the bottom segment includes at least one aperture to receive a securement device to secure the device to a wall.

14. The integration device of claim 1, wherein the device comprises a latch mechanism defined by the first member and the second member to latch the device in the closed configuration when an interior of the second member is empty.

15. The integration device of claim 14, wherein the latch mechanism includes a latch ridge of the first member that cooperates with a latch ridge of the second member.

16. The integration device of claim 1, wherein the first and second guide members respectively exert a force on the top tray cover from below the top tray cover upon an upward force exerted to the lid.

17. The integration device of claim 1, wherein the lid comprises a fourth guide member to engage a back of the cover.

18. The integration device of claim 1, wherein the lid comprises at least one securement structure to couple the lid to the first member, the securement structure including a first and second securement finger couplable to the first member and an abutment finger spaced from the first and second securement fingers, wherein the abutment finger cooperates with a recessed portion of the first member.

19. The integration device of claim 18, wherein the abutment finger includes a cammed section that engages the recessed portion of the first member.

20. The integration device of claim 19, wherein portions of the cammed section respectively correspond to different open positions of the lid.

21. The integration device of claim 18, wherein the securement structure includes a recess disposed between the first securement finger and the second securement finger to impart flexibility to the securement structure.

22. The integration device of claim 1, wherein the lid comprises a third guide member to engage a finger tab of the cover.

23. A method of integrating a device with a container, comprising:

providing an integration device, having:

a first member having a lock device, and a second member coupled to the first member, wherein the second member receives a container therein having a cover, the first member being movable with respect to the second member between an open configuration and a closed configuration, wherein the cover cooperates with the lock device to lock the first member with the second member in the closed configuration, and a lid coupled to the first member, wherein the lid is engageable with a top tray of the cover to transition the cover between a closed position and an open position, and wherein the lid comprises a first guide member at a first side thereof and a second guide member at a second side thereof, and wherein the first guide member and the second guide member couple with the top tray of the cover to transition the cover between the closed position and the open position, and wherein the first and second guide members respectively are housed within first and second apertures of the second member;

inserting a container having a cover into the second member; and moving the first member with respect to the second member to the closed configuration by engaging the cover with the lock device to lock the first member with the second member in the closed configuration.

* * * * *